US006534015B1

(12) United States Patent
Viot et al.

(10) Patent No.: US 6,534,015 B1
(45) Date of Patent: Mar. 18, 2003

(54) ASSEMBLY COMPRISING STACKED PIPETTE CONE REFILLS

(75) Inventors: Francois Viot, Auvers-sur-Oise (FR); Jocelyn Vecchio, Vitry-sur-Seine (FR)

(73) Assignee: Gilson, Inc., Middleton, WI (US)

( * ) Notice: Subject to any disclaimer, the term of this patent is extended or adjusted under 35 U.S.C. 154(b) by 0 days.

(21) Appl. No.: 09/555,821

(22) PCT Filed: Oct. 5, 1999

(86) PCT No.: PCT/FR99/02374

§ 371 (c)(1),
(2), (4) Date: Jun. 5, 2000

(87) PCT Pub. No.: WO00/20118

PCT Pub. Date: Apr. 13, 2000

(30) Foreign Application Priority Data

Oct. 6, 1998 (FR) ..... 98 12492

(51) Int. Cl.[7] ..... B01L 9/00; B01L 3/00; B65D 21/00; B65D 85/62; B65D 1/34; B65D 6/04; A47B 43/00; A47F 1/04; A47F 7/00; A47F 5/08

(52) U.S. Cl. ..... 422/102; 422/99; 422/104; 206/503; 206/506; 206/507; 206/561; 206/562; 206/563; 211/194; 211/60.1; 211/85.17; 211/88.01

(58) Field of Search ..... 422/99, 102, 104; 206/499, 503, 506, 507, 486, 561, 562, 563; 211/188, 194, 60.1, 85.17, 88.01

(56) References Cited

U.S. PATENT DOCUMENTS 3,937,322 A * 2/1976 Cohen
4,130,978 A * 12/1978 Cohen
4,577,760 A * 3/1986 Rainin et al
5,324,482 A * 6/1994 Scaramella et al.
5,366,088 A 11/1994 Hill et al. ..... 206/499
5,392,914 A * 2/1995 Lemieux et al.
5,441,702 A 8/1995 Lemieux et al. ..... 422/100
5,470,538 A * 11/1995 Lind
5,612,000 A * 3/1997 Lemieux
5,622,676 A * 4/1997 Lind
5,642,816 A * 7/1997 Kelly et al.
5,779,984 A * 7/1998 Kelly et al.
5,827,745 A * 10/1998 Astle
5,948,362 A * 9/1999 Steinbrenner et al.
6,007,779 A * 12/1999 Lemieux et al.
6,328,933 B1 * 12/2001 Labriola et al.
6,405,870 B1 * 6/2002 Lahti et al. ..... 206/499
6,419,086 B1 * 7/2002 Vecchio ..... 206/366

FOREIGN PATENT DOCUMENTS

WO WO 95 33564 12/1995

* cited by examiner

*Primary Examiner*—Jill Warden
*Assistant Examiner*—Brian R Gordon
(74) *Attorney, Agent, or Firm*—Greer, Burns & Crain, Ltd.; Philip M. Kolehmainen

(57) ABSTRACT

A number of racks make up a stack. An upper rack includes releasable catches received into orifices in the next lower rack to releasably attach the two racks to one another. A loader and receptacle cooperate with one another to release the bottommost rack from the stack and deposit it into the receptacle where pipette cones held therein are accessible for use. The bottom rack is placed into the loader where it is held by catches engaging ribs of the rack. The stack of racks with the loader attached is placed onto the receptacle. The stack of racks is pressed downwardly. The downward movement releases the bottom rack from the loader. At the same time, studs projecting up from the bottom of the receptacle engage catches of the second-from-the-bottom rack and free the bottom rack. The bottom rack now rests freely in the receptacle.

14 Claims, 17 Drawing Sheets

FIG_11
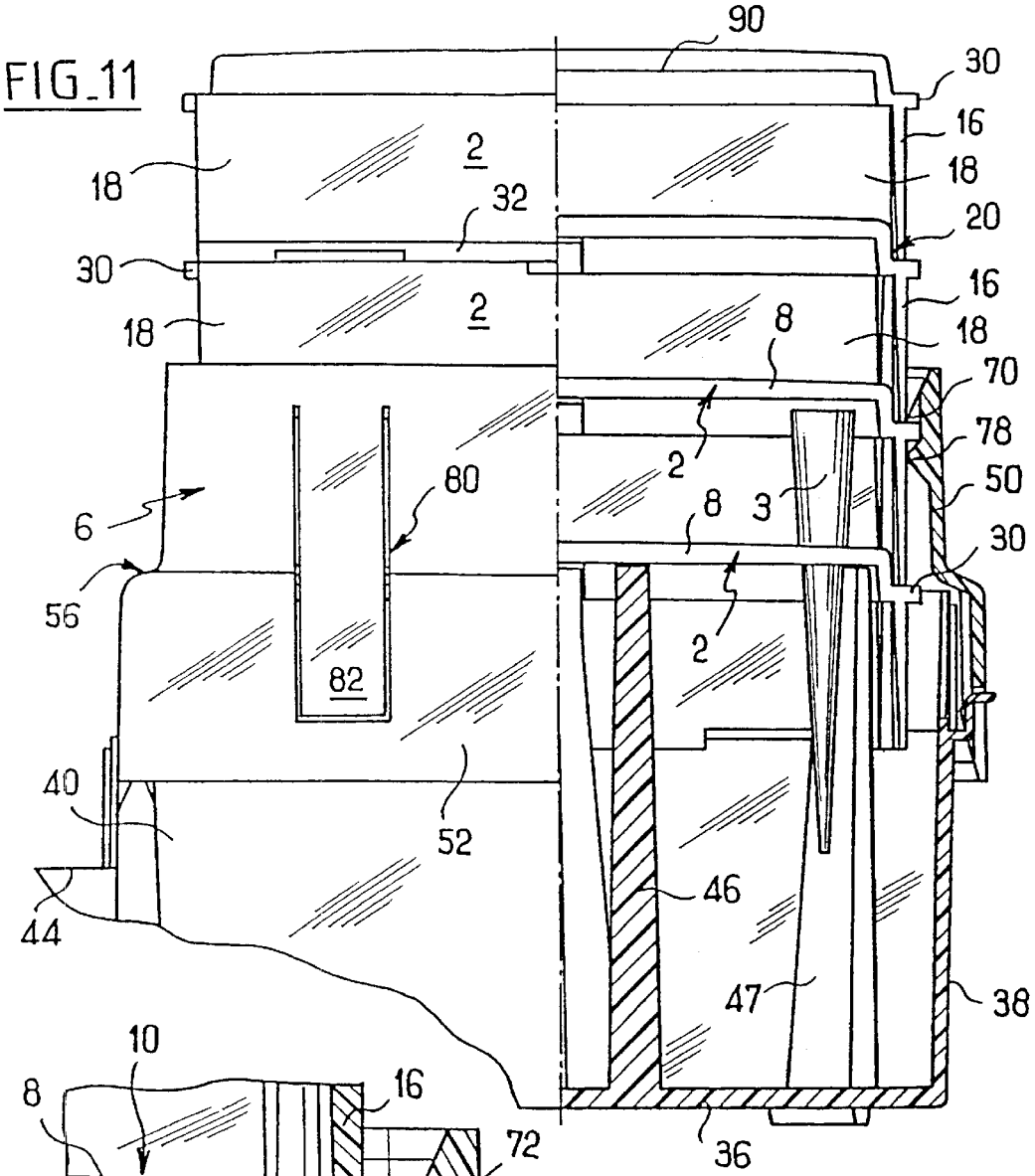
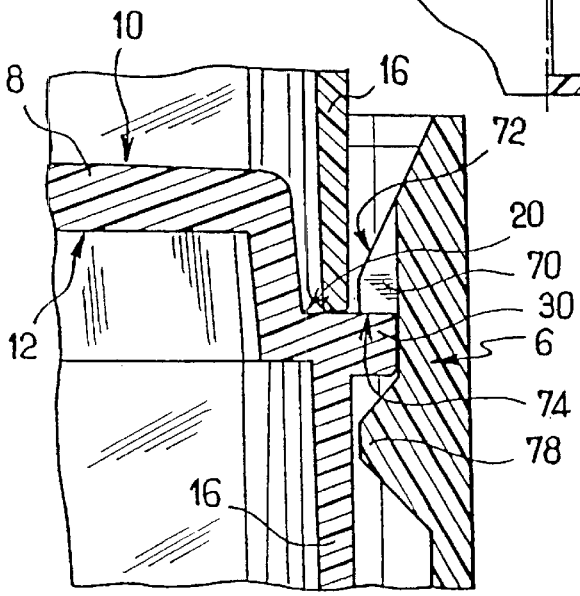
FIG_12

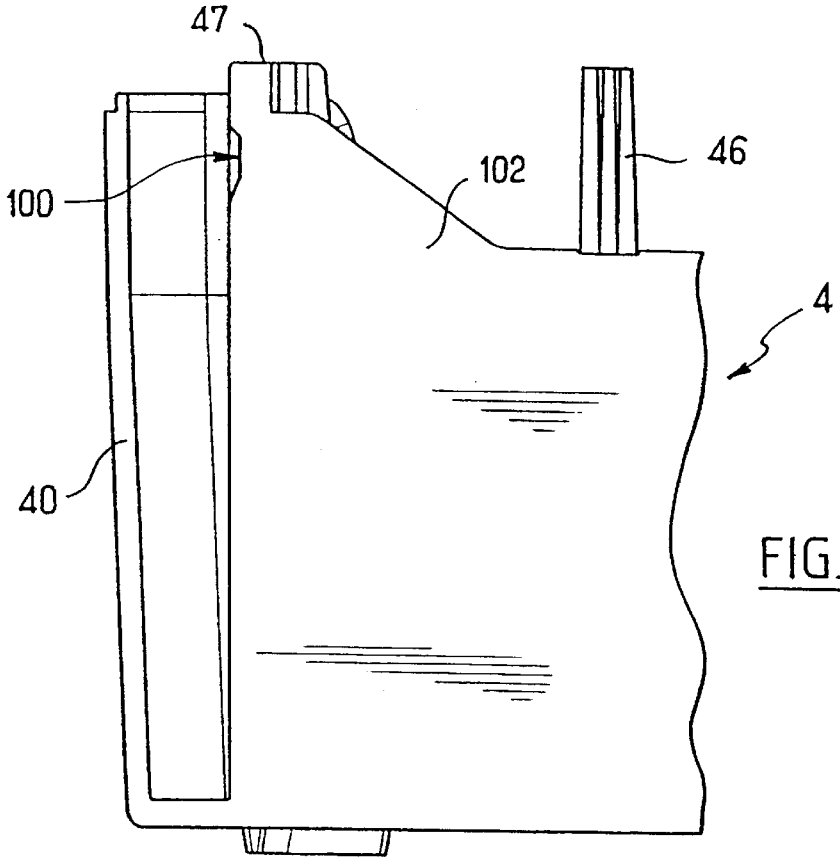
FIG_19
FIG_21
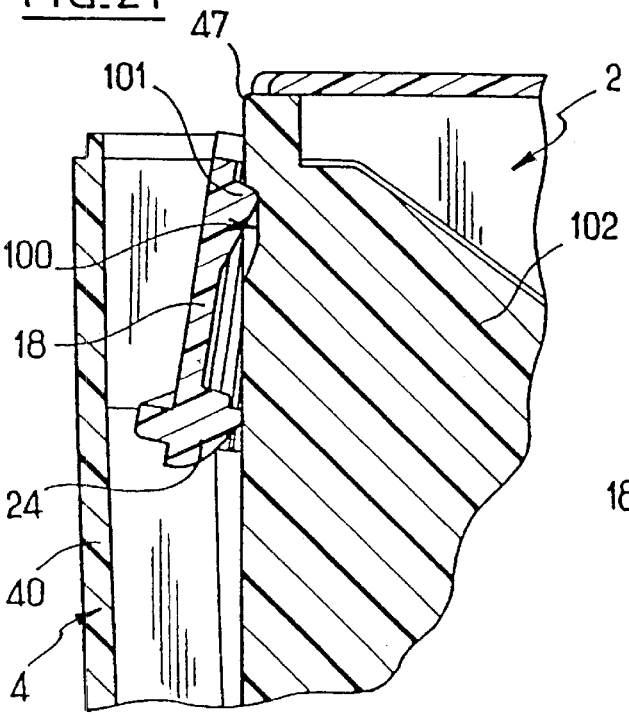
FIG_20
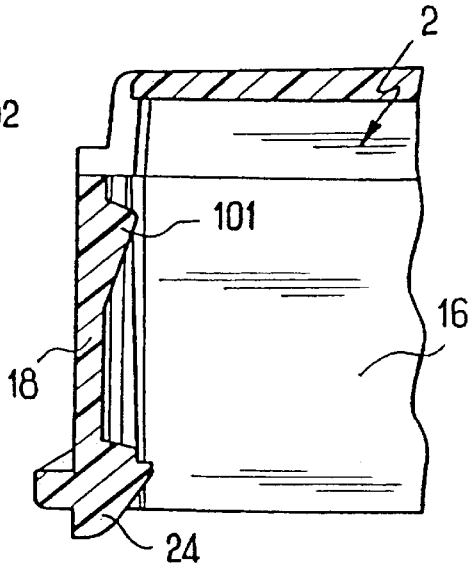

FIG. 24
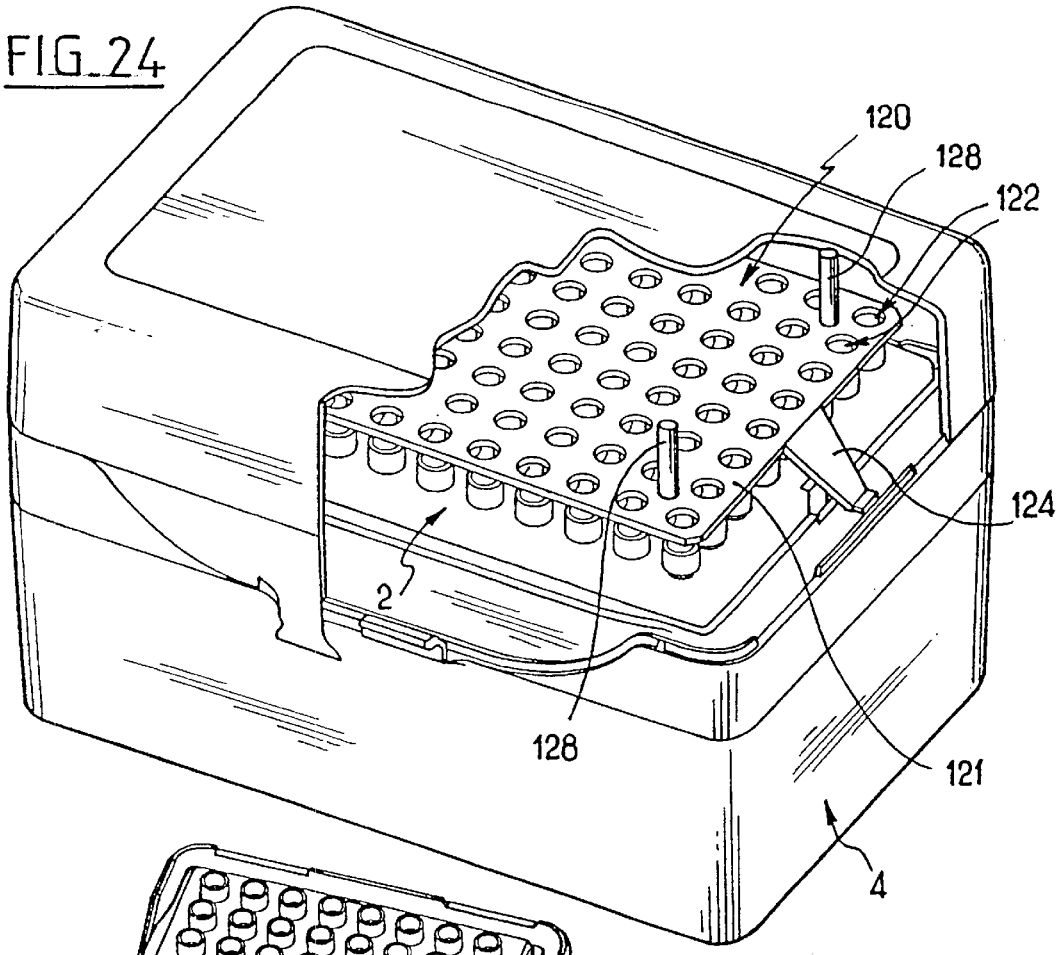
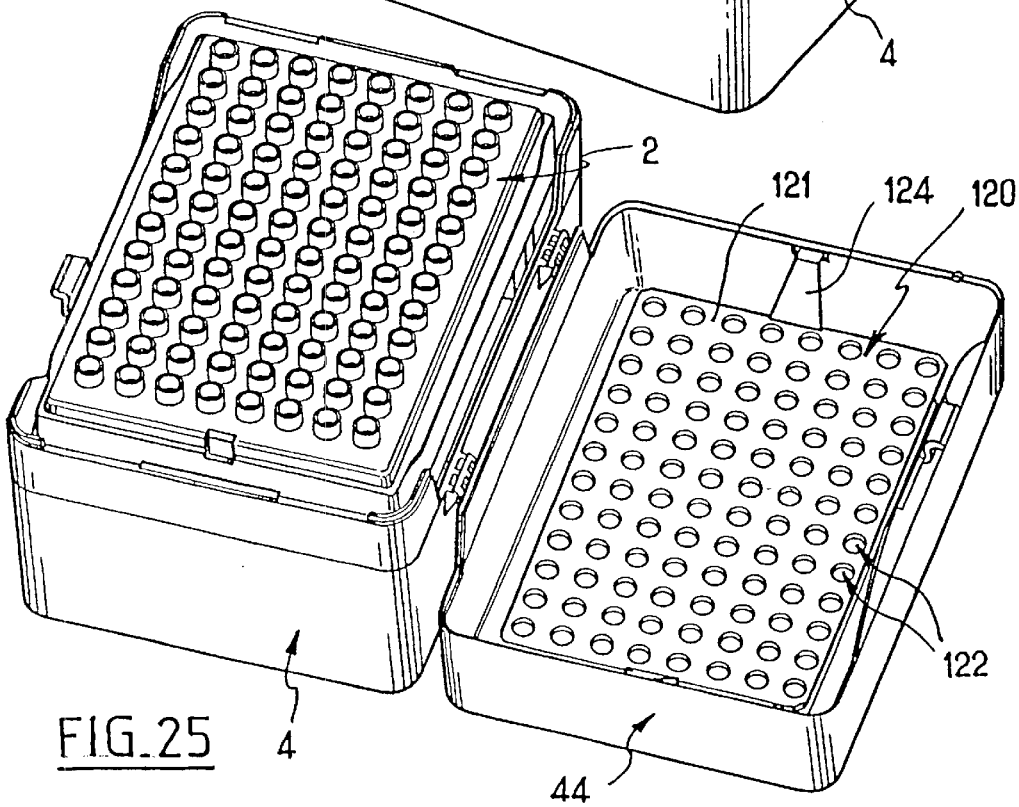
FIG. 25

ASSEMBLY COMPRISING STACKED PIPETTE CONE REFILLS

BACKGROUND OF THE INVENTION

1. Field of the Invention

The invention relates to assemblies comprising stacks refills containing elements such as pipette cones.

2. Background of the Invention

An assembly of this type is known comprising a series of stacked trays each carrying pipette cones, the trays being enclosed in a case of transparent material in the form of a tower that is closed at its top end. The tower can receive a loader at its bottom end, thereby temporarily fixing the trays of the stack to one another. Since the trays are placed one on another in the stack, it is necessary to turn the tower upside-down to place the loader at its top end in order to prevent the trays and the cones becoming dispersed. It is only afterwards that the tower can be put back the right way up. The loader is in turn mounted on a rack or carrier. With the stack and the loader received in this way on the rack, the assembly is arranged in such a manner that downward pressure on the stack causes it to move downwards and a tray to be loaded onto the rack. Thereafter the rack is removed from the loader and the stack to give access to the pipette cones of the tray thus received on the rack. That type of tower has the advantages of being relatively simple to operate, that it saves space for storing the trays and thus the cones, and that it avoids direct contact between the user and the trays or the cones, which could contaminate them. Nevertheless, the assembly is still relatively bulky and difficult to manipulate.

SUMMARY OF THE INVENTION

An object of the invention is to provide a refill assembly that is simpler to manipulate and that is more compact.

To achieve this object, the invention provides an assembly for elements, in particular pipette cones, the assembly comprising at least two refills suitable for forming a stack and carrying elements, loader means for receiving the stack and separating one of the refills from the remainder of the stack, and fixing means for fixing the refills to one another within the stack, wherein at least one of the refills comprises the fixing means.

Thus, since the refills are fixed directly to one another, there is no need to provide a rigid case containing the stack of refills. Under such circumstances, in the absence of such a case, the height of the stack decreases as the refills are used up. This gives rise to a considerable saving of space. The assembly nevertheless remains simple to manipulate.

Advantageously, the fixing means comprise fixing portions suitable for mutual male-female engagement.

Thus, the fixing means are compact.

Advantageously, the loader means are suitable for applying force to the fixing portions so as to disengage them.

Advantageously, on each refill, the fixing means comprise an orifice, and a catch suitable for engaging the orifice of another refill.

Advantageously, the loader means include a member suitable for applying force to the catch from a side of the orifice opposite from the catch.

Advantageously, the loader means are suitable for carrying the stack prior to unlocking the fixing means.

Thus, the stack is supported by the loader means before the user causes a refill to be released from the stack.

Advantageously, the loader means are suitable for carrying the remainder of the stack after the fixing means have been unlocked.

Thus, the remainder of the stack is supported separately from the released refill.

Advantageously, the loader means are suitable for carrying the stack or the remainder of the stack via a single refill.

Advantageously, the assembly includes fixing means for fixing the stack to the loader means, in particular prior to the refill fixing means being unlocked.

Thus, it is easy to move the assembly without running the risk of causing it to fall apart.

Advantageously, the stack fixing means are suitable for fixing a single refill of the stack to the loader means.

Advantageously, the assembly includes fixing means for fixing the remainder of the stack to the loader means, in particular after the refill fixing means have been unlocked.

Thus, it is easy to access the released refill without causing the remainder of the stack to come apart.

Advantageously, the fixing means of the remainder of the stack are suitable for fixing a single refill of the remainder of the stack to the loader means.

Advantageously, the assembly includes centering means for centering the stack on the loader means.

This makes them easier to assemble.

Advantageously, the loader means comprise at least one portion in relief that is movable between a locking position in which it prevents relative displacement of one of the refills and a transfer position in which it allows such displacement.

Advantageously, the assembly includes return means for returning the portion in relief into the locking position.

Advantageously, the portion in relief is suitable for being moved from the locking position to the transfer position under the effect of the portion in relief being subjected to a force from the refill.

Thus, the refill is released under the effect of the user applying a force in this direction to the assembly, thereby reducing the risk of the refill being released in untimely manner.

Advantageously, the loader means are suitable for unlocking the refill fixing means when the refill is in an in-use position for the elements.

Thus, unlocking to separate a refill is automatic. Having the refills fixed directly in one another therefore does not prevent the assembly being simple to manipulate.

Advantageously, the loader means are suitable for unlocking the refill fixing means under the effect of the stack moving relative to the loader means.

Advantageously, the loader means comprise a receptacle suitable for receiving one of the refills in an in-use position for the elements after the refill has been separated from the stack.

Advantageously, the assembly includes centering means for centering one of the refills on the receptacle.

This facilitates transfer of a refill onto the receptacle.

Advantageously, the loader means comprise a loader suitable for receiving the stack, and a receptacle suitable for receiving one of the refills in the in-use position for the elements from the loader.

Advantageously, the assembly includes means for centering the loader on the receptacle.

Advantageously, the receptacle is suitable for receiving the refill from the loader under the effect of the stack moving relative to the loader mounted on the receptacle.

Advantageously, the assembly is arranged in such a manner that the stack provides greater resistance to said movement when the loader is separate from the receptacle than when it is mounted on the receptacle.

This reduces the risk of a refill being released in untimely manner from the stack while the loader is not received on the receptacle.

Advantageously, the receptacle is suitable for unlocking the fixing means.

Advantageously, for the portion in relief belonging to the loader, the receptacle is suitable for placing the portion in relief in an intermediate position between the locking position and the transfer position, or in the transfer position, when the loader is received on the receptacle.

Thus, the position of the loader on the receptacle makes it easier to release the refill. This reduces the risk of release occurring outside the receptacle without making it more difficult to release a refill on the receptacle.

Advantageously, the assembly is arranged in such a manner that when the loader is not received on the receptacle, one of the refills co-operates by a camming effect with the loader so as to tend to hold the portion in relief in the locking position when a force is applied to the stack in order to achieve said displacement.

Advantageously, the portion in relief is secured to a tab extending in an opening in a wall of the loader means, in particular of the loader.

Advantageously, the portion in relief is secured to a flexible wall of the loader means, in particular of the loader.

Advantageously, each refill comprises a tray and at least one rib parallel to the tray and projecting from a side face of the refill.

This rib can co-operate with the portion in relief for fixing and/or releasing the refill.

Advantageously, each refill comprises a tray and spacers suitable for supporting the tray on a plane support and at a distance therefrom.

Thus, the refill when separated from the stack can be used directly as a rack without needing to be associated with a rack specifically provided for that purpose, e.g. in the receptacle, as is the case in prior devices. This eliminates the problem which consisted in ensuring proper centering between the refill to be released and the receiving rack in order to obtain accurate coincidence of their respective orifices arranged in a matrix, where failure to obtain such centering would either prevent release from taking place or else cause the cones to be dispersed. Furthermore, since the receptacle no longer has to carry a rack to begin with, it can be used successively to receive refills carrying elements of different sizes. Finally, the racks can be designed so that they themselves constitute a stack which is closed at least in part, thereby causing the elements carried by at least some of the racks to be isolated from the outside. These elements are thus protected from the surroundings.

Advantageously, one of the orifice and the catch is contiguous with an edge of the tray.

Advantageously, the assembly is arranged in such a manner that receiving a refill in the in-use position on the receptacle causes the refill to be fixed rigidly to the receptacle.

Advantageously, each refill includes at least one catch suitable for co-operating with a portion in relief of the receptacle in order to achieve said rigid fixing.

Advantageously, the assembly includes a stand suitable for directly supporting the stack when the loader is carrying the stack and when the receptacle is not receiving the loader.

Advantageously, the receptacle includes a lid and a holder suitable for extending in register with elements of a rack received in the receptacle so as to prevent the elements from leaving the rack when the lid closes the receptacle, the holder and the lid having means for releasably securing the holder to the lid.

The invention also provides an assembly for elements, in particular for pipette cones, the assembly comprising at least one refill suitable for carrying elements and forming a stack with an identical refill, loader means for receiving the stack and for separating the refill from the remainder of the stack, and fixing means for fixing the refill to an identical refill in the stack, wherein the refill comprises the fixing means.

Other characteristics and advantages of the invention will appear further in the following description of two preferred embodiments given as non-limiting examples. In the accompanying drawings:

BRIEF DESCRIPTION OF THE DRAWINGS

FIG. 11 is a view analogous to FIG. 10 showing the assembly after a rack has been loaded;

FIG. 12 is a view on a larger scale showing a detail of FIGS. 10 and 11;

FIGS. 19 to 21 are fragmentary longitudinal section views respectively of the box of FIG. 18, of the rack of FIG. 17, and of the box receiving the rack;

FIGS. 22 to 24 are partially cutaway views respectively in perspective, in elevation, and in perspective showing the box of FIG. 18 of the second embodiment in its closed position and receiving a rack with a holder;

FIG. 25 is a perspective view of the FIG. 24 assembly with the box open;

DETAILED DESCRIPTION OF THE PREFERRED EMBODIMENT

Figure 1:
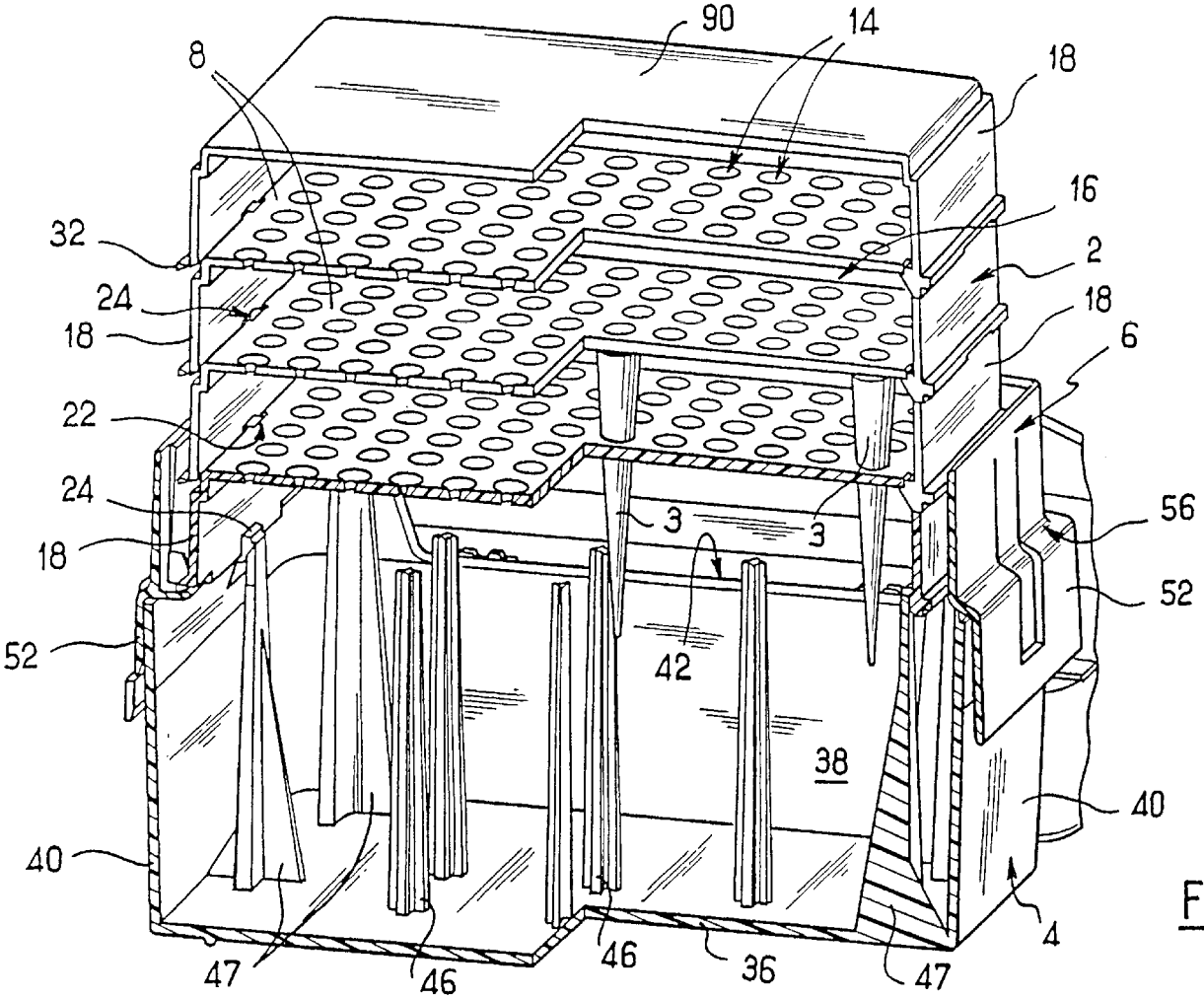
FIG. 1 is a cutaway perspective view of a first preferred embodiment of the assembly of the invention prior to loading a rack in the case.

In the first embodiment of the invention, the assembly of FIG. 1 is designed to carry elements, and specifically pipette tips or cones 3. The assembly comprises a plurality of refills 2, in this case identical to one another, and specifically in the form of racks or carriers. It also comprises a receptacle, in this case in the form of a box 4, and a loader 6. The box and the loader constitute loader means.

The racks 2 are described first. Each rack comprises a generally plane tray 8 in the form of a plane rectangle. In conventional manner, the tray 8 presents orifices 14 disposed regularly in a matrix of rows and columns, adapted to receive the pipette cones 3 and to support them. More precisely, the tray 8 has a top face 10 and a bottom face 12 which are respectively slightly convex and slightly concave. This makes it easier to take the pipette cones 3 with a multichannel pipette by making it easier to engage the cones in a row successively on the respective channels of the pipette by an appropriate rocking motion of the user's hand.

The rack 2 has two longitudinal walls 16 and two transverse walls 18 extending perpendicularly to the general plane of the tray 8, from the same face thereof, extending from its edges and giving the rack the general shape of a rectangular parallelepiped. At the junction between the tray and each longitudinal or transverse wall, the rack has a shaped shoulder 20 suitable for receiving the bottom free edges of the longitudinal and transverse walls of another rack 2 when two racks 2 are stacked directly one on another in corresponding positions, as shown in FIG. 1, with their trays 8 being parallel. Thus, the tray 8 of a lower rack in a stack penetrates a little way between the walls 16, 18 of the rack above it. As a result, the two racks are centered and spaced apart relative to each other. In addition, the longitudinal walls 16 and transverse walls 18 of the two racks then extend continuously one from another, thereby isolating the cones 3 to some extent from the surroundings. The racks are thus suitable for being stacked on one another to make up a stack in the form of a tower which can have a height of ten to twelve racks before the cones start being used. To clarify the drawings, the stack shown in the figures has only four racks. The walls of each rack constitute spacers for supporting the rack on a plane support with the tray 8 of the rack extending at a distance therefrom.

Figure 13:
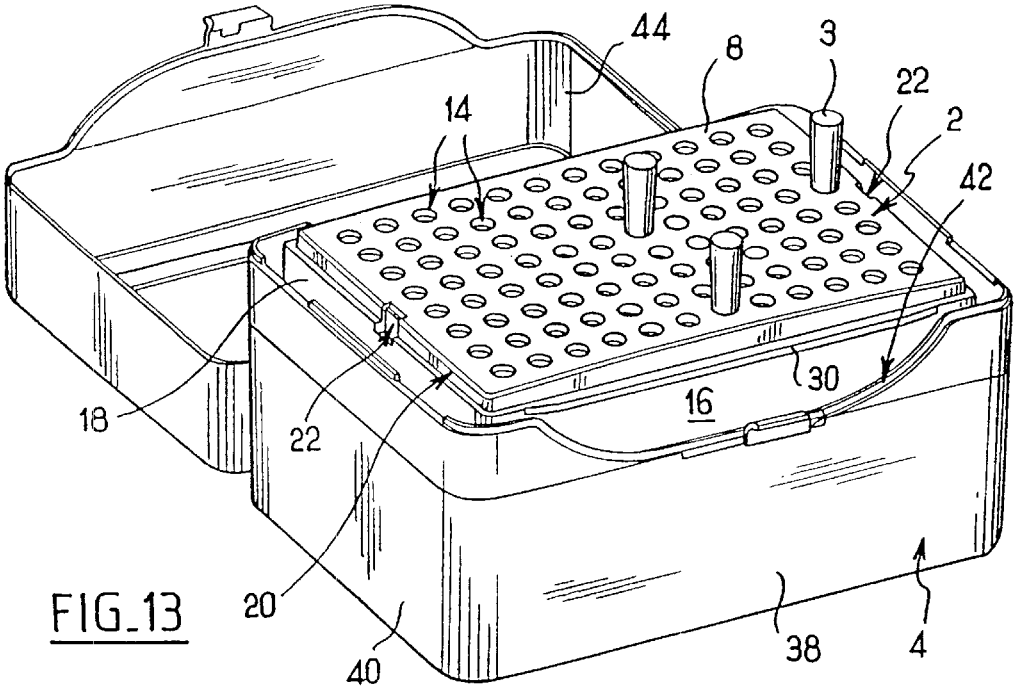
FIGS. 13 and 14 are perspective views of the FIG. 1 box respectively with a rack and without a rack.
Figure 14:
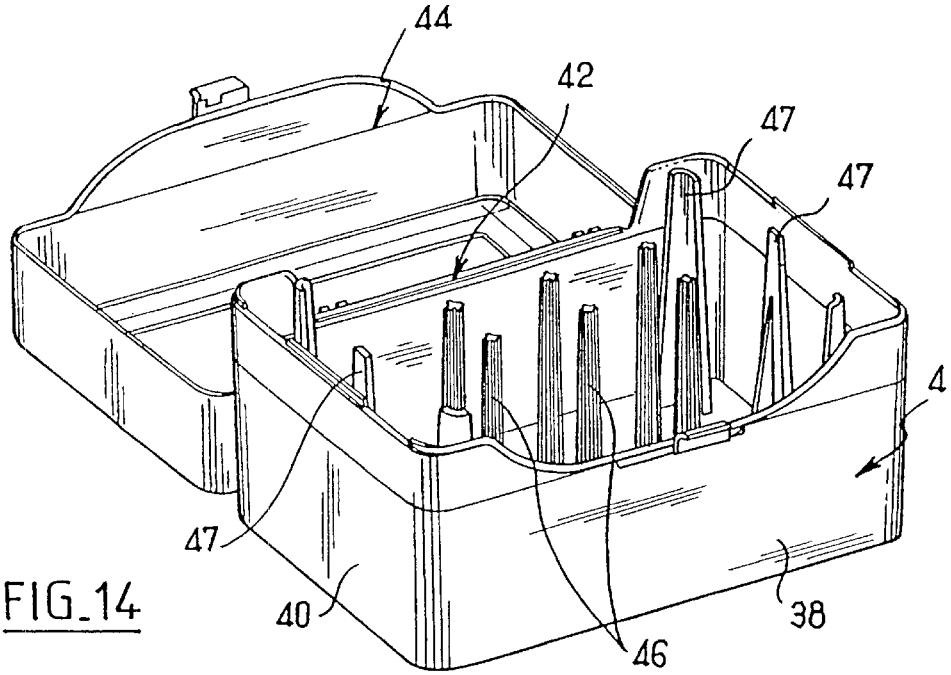
Figure 15:
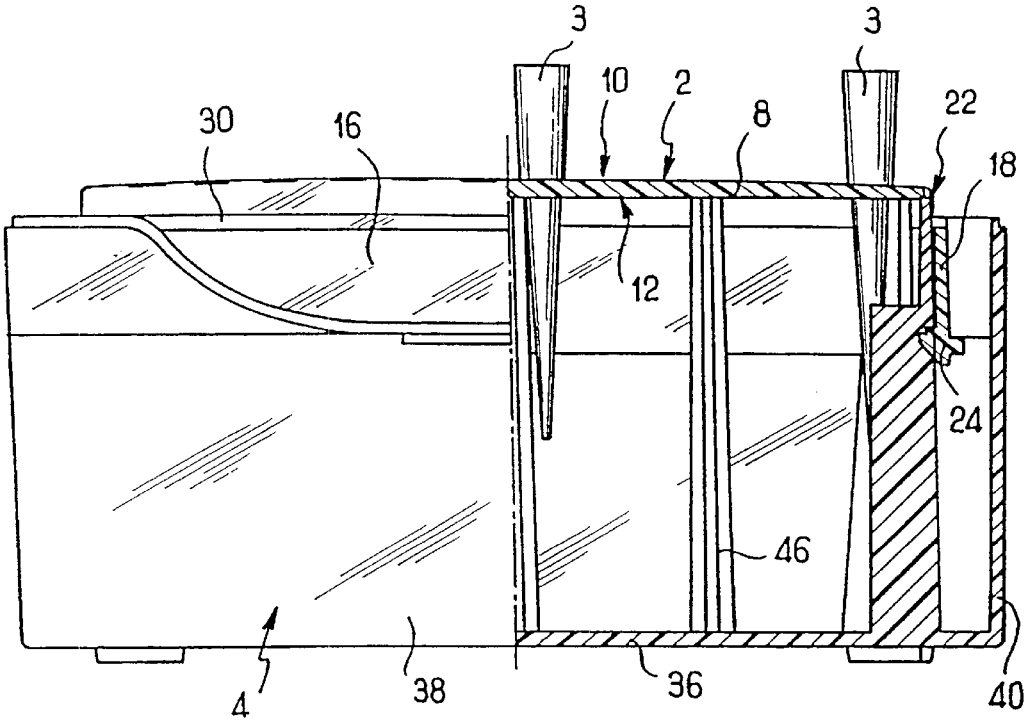
FIG. 15 is a view half in elevation and half in cross-section of the box of FIG. 13.
Figure 16:
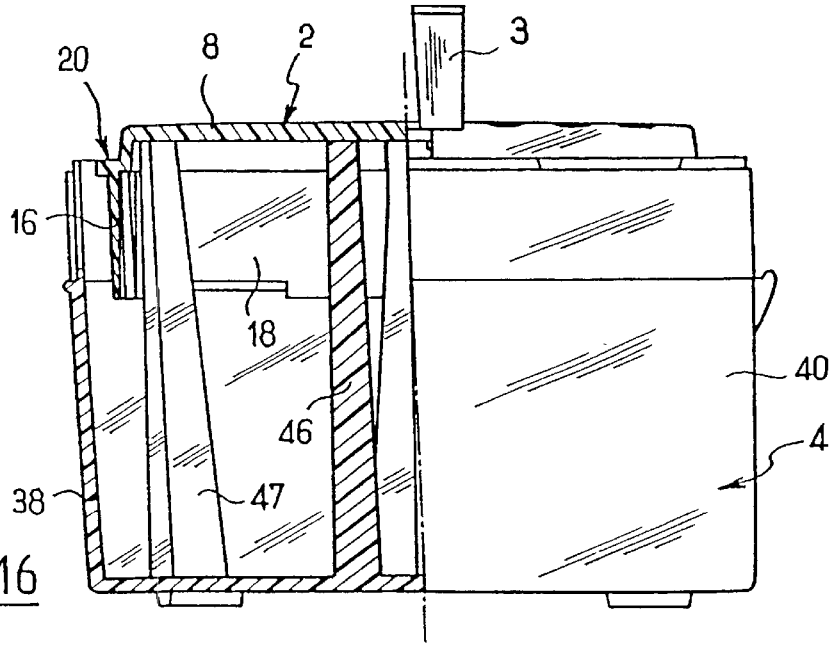
FIG. 16 is a view half in cross-section and half side view of the box of FIG. 13.
Figure 17:
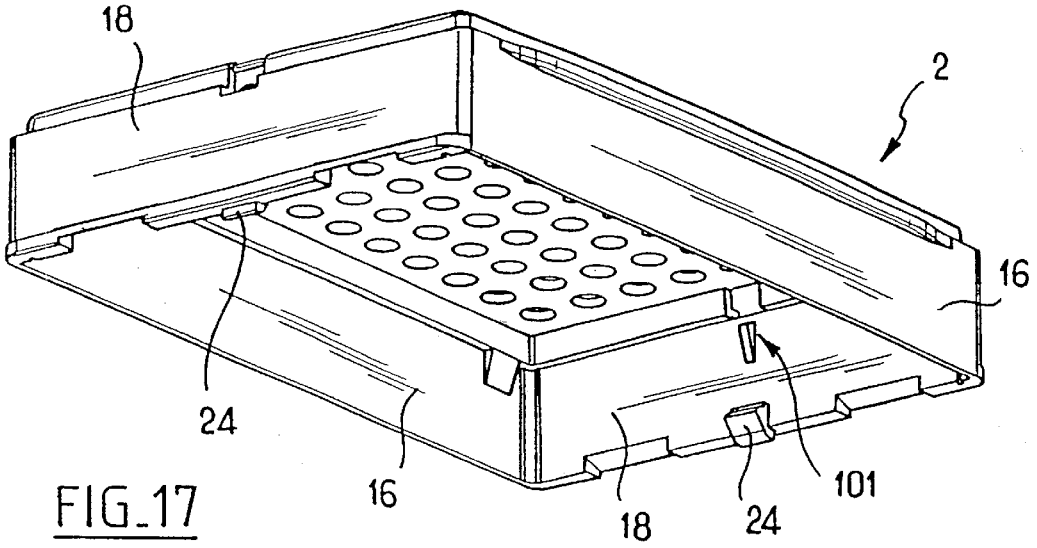
FIG. 17 is a perspective view from below of a rack in a second embodiment.
Figure 18:
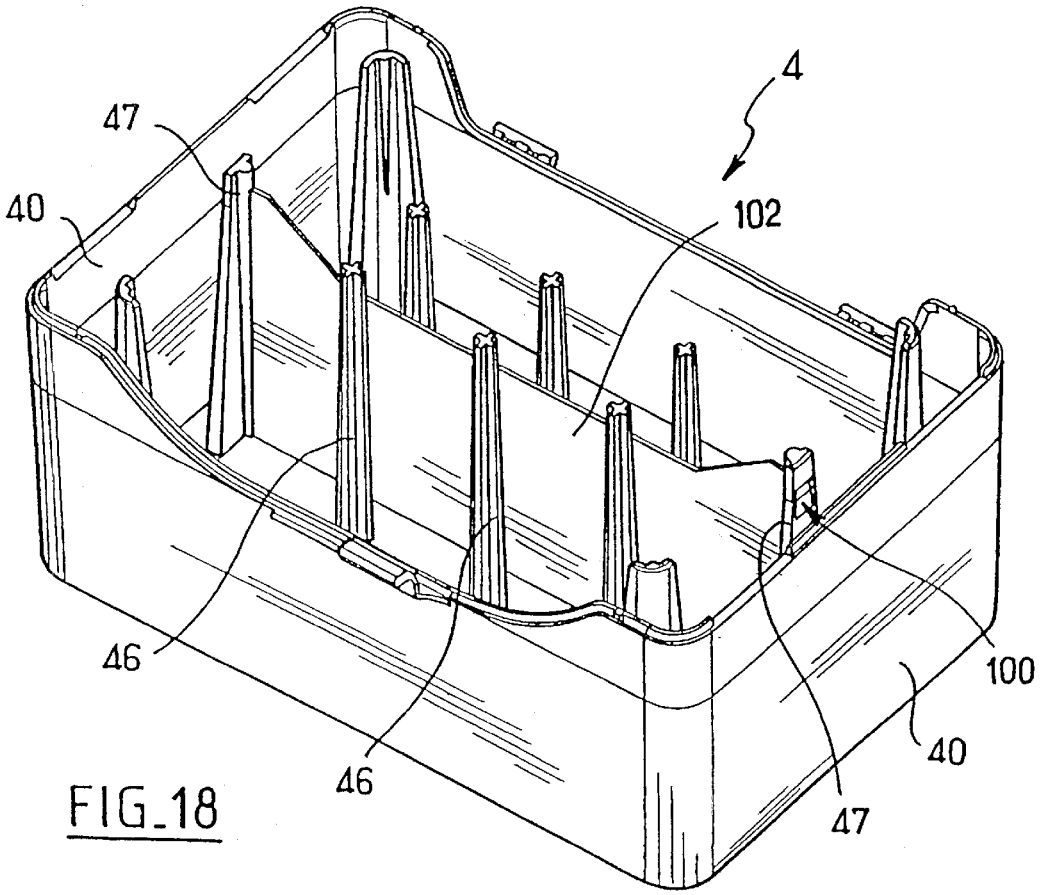
FIG. 18 is a perspective view from above of the box in the second embodiment for co-operating with the rack of FIG. 17.
Figure 22:
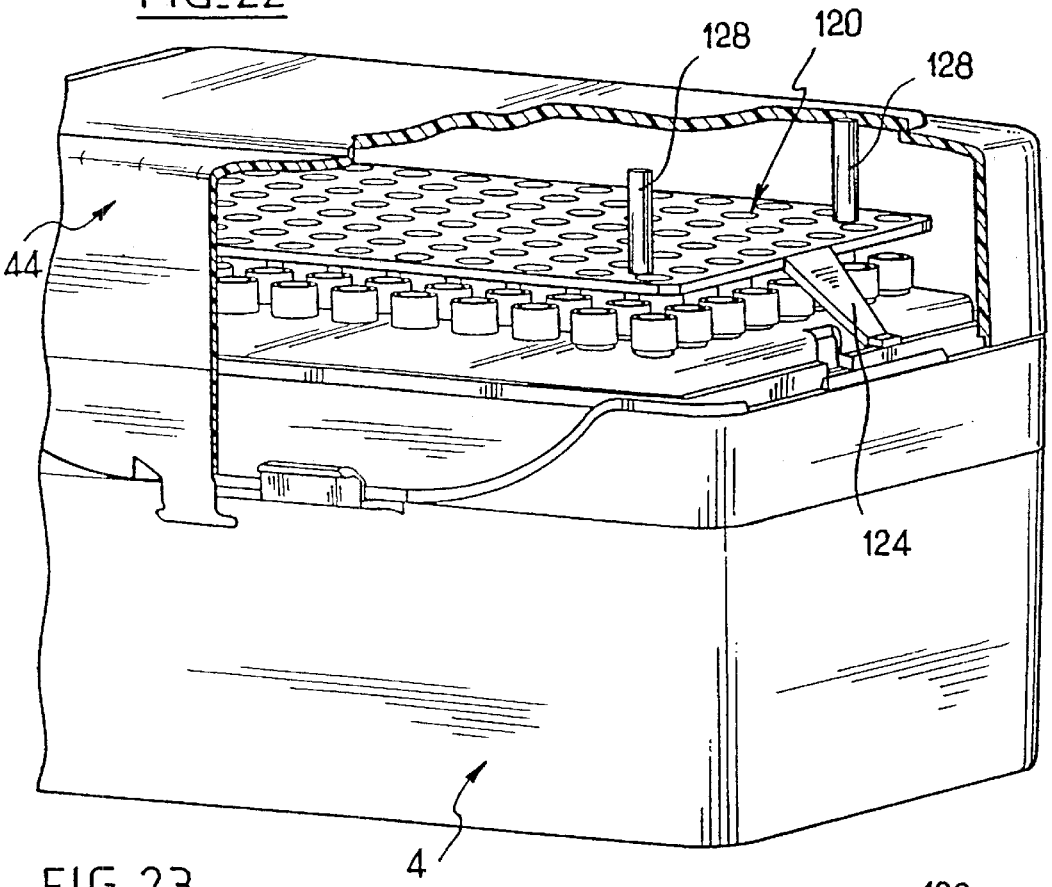
Figure 23:
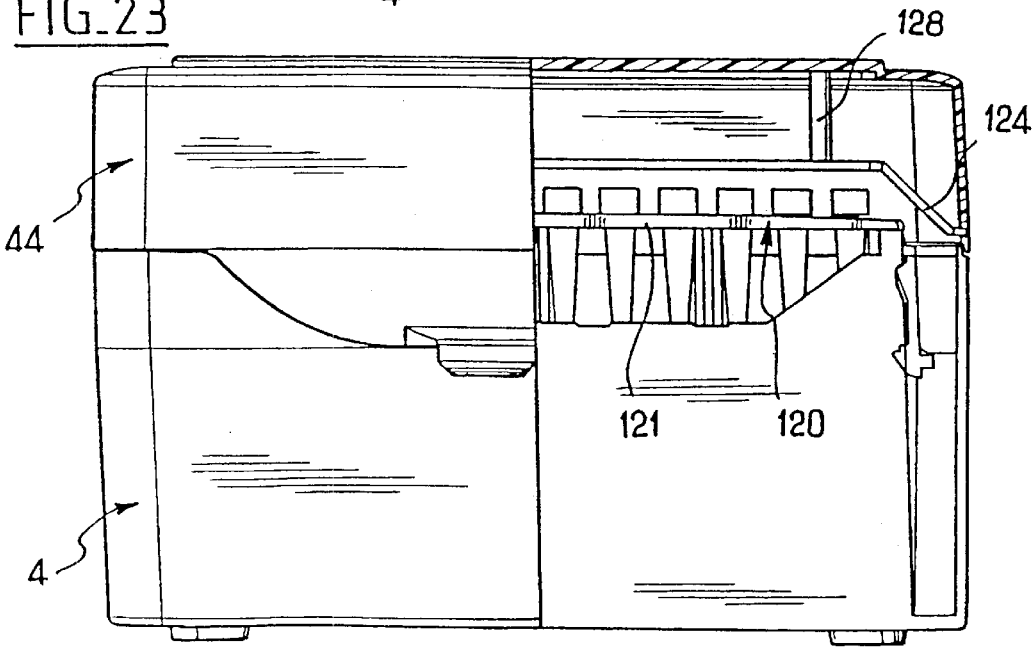
Figure 26:
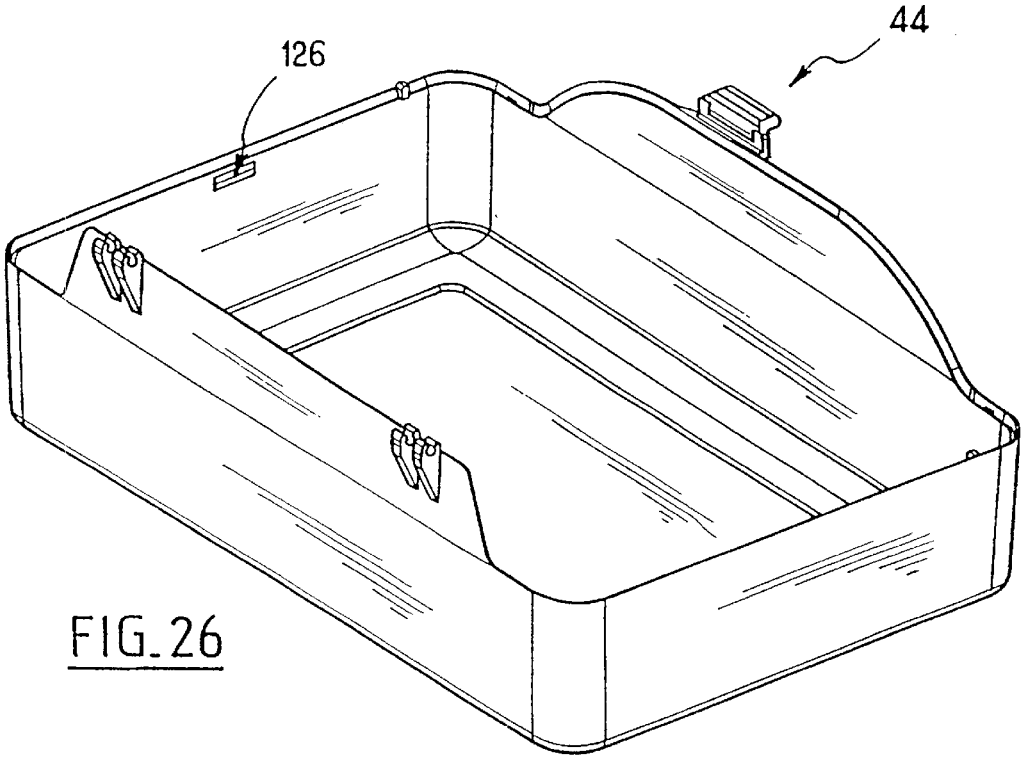
FIG. 26 is a perspective view of the lid of the FIG. 22 box on its own.
Figure 27:
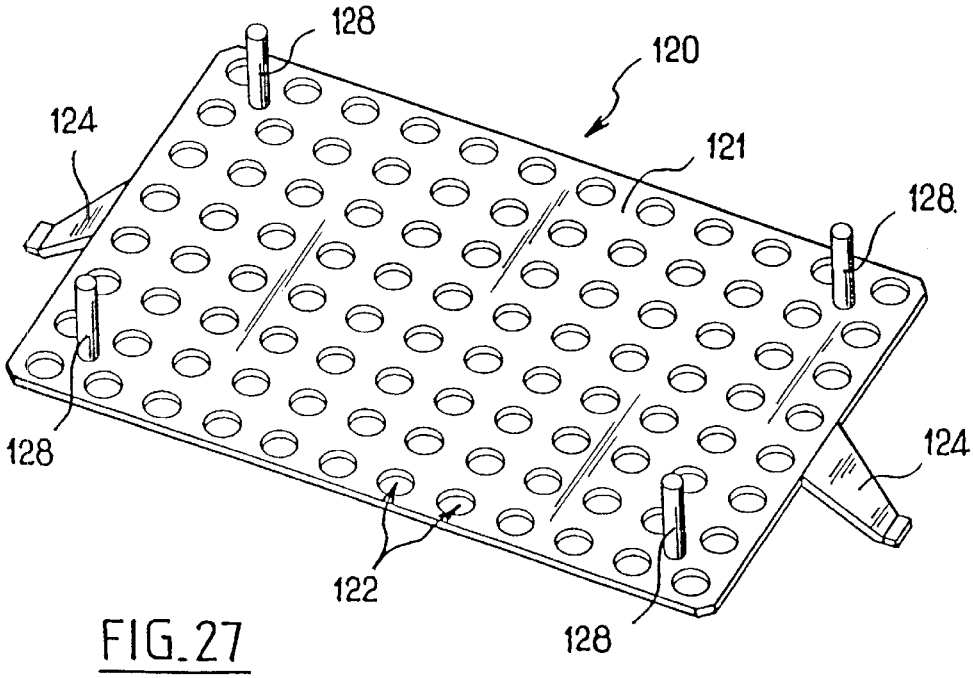
FIG. 27 is a perspective view of the holder of FIG. 22 on its own.
Figure 28:
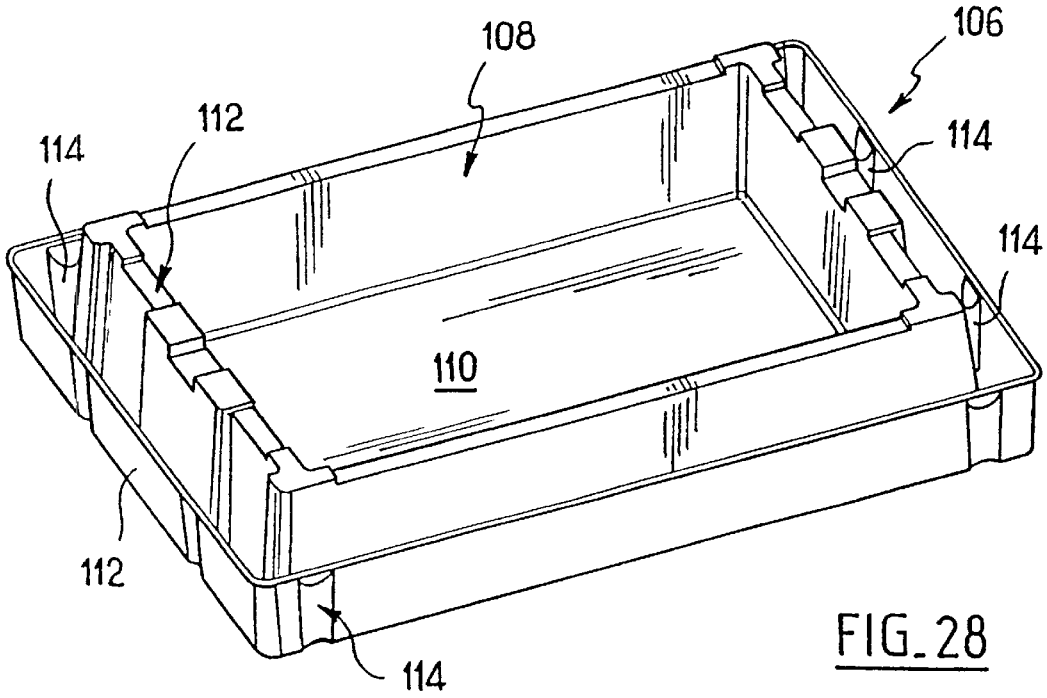
FIG. 28 is a perspective view of a stand forming a portion of the second embodiment of the invention.

The racks 2 have direct fixing means that emerge between one another in the stack, said fixing means being constituted by fixing portions suitable for providing male-female coupling for fixing the racks together. Specifically, with reference in particular to FIGS. 2, 3, and 13, each rack has two rectangular orifices 22 formed in the tray 8 in the middles of its transverse edges, contiguous with the shoulder 20. In addition, each transverse wall 18 has in its middle, at its bottom free edge, a catch 24 extending towards the inside of the rack and suitable for engaging in the orifice 22 of the rack beneath it in the stack.

This catch has a plane bottom guide face 26 that slopes relative to the wall 18 carrying the catch and relative to the tray 8, facing towards the bottom rack of the stack. The orifice 22 has a top edge designed to come into contact with the guide face 26 and presenting a top guide facet 24 that slopes relative to the tray 8 and to the adjacent end face 18 so as to be parallel to the guide face 26 of the catch. When two racks 2 are stacked one on the other, the guide faces 26 of the two catches 24 come into surface contact with the facets 28 of the corresponding orifices 22, thereby forcing outwards each transverse wall 18 that carries a catch 24 so that the catch 24 can move past the edge of the orifice 22. Because of the resilience of the material constituting the wall 18, the catch 24 is then returned towards the orifice 22 so as to be received therein.

The edge of the orifice 22 contiguous with the bottom face 12 of the tray is sharp and male. The top end of the catch 24 has a top shaped female shoulder suitable for receiving the sharp edge. The sharp edge and the shoulder are arranged in such a manner that when the catch 24 is engaged in the orifice 22, the racks can be separated only by forcing the catch 24 outwards.

Each rack has a rectilinear rib 30 parallel to the tray 8 and projecting from the outside face of each longitudinal wall 16, contiguously with the shoulder 20, and also has a rectilinear rib 32 parallel to the tray and extending from the outside face of each transverse wall 18 contiguously with the free bottom edge of said wall. The ribs 30 and 32 are suitable for co-operating with the loader and the box as explained below. Each rack 2 can be made as a single piece of plastics material.

The box 4 is described below. It has a plane bottom wall 36, two longitudinal walls 38, and two transverse walls 40 extending perpendicularly from the bottom wall to give the box the general shape of a rectangular parallelepiped. At their free top edges, the longitudinal walls 38 have respective setbacks 42 making it easier to take hold of a rack 2 housed in the box in order to extract it. The box 4 has a lid 44 generally in the form of a rectangular parallelepiped connected to the rear longitudinal wall 38 via hinges. With the lid in the closed position, the box isolates the rack contained inside the box from the outside.

The box has studs 46, 47 extending parallel to one another parallel to the walls 38, 40, projecting from the bottom 36 of the box to a level close to the level of the free top edges of the walls. Six of the studs 46 are close to the center of the box (they are referred to as "central" studs) and the other six studs 47 extend close to the transverse walls 40 (they are referred as "peripheral" studs), two studs close to the vertical edges of each wall and a middle stud in the vicinity of the center of the wall 40. The purpose of the central studs 46 is specifically to support the tray 8 of the rack via its bottom face 12 bearing on the studs when the rack is received in the box. The peripheral studs 47 come into contact with the inside faces of the transverse walls 18 and the longitudinal walls 16 of the rack to center it relative to the box. The two middle peripheral studs penetrate slightly into the respective orifices 22, in particular to finish off centering.

Figure 4:
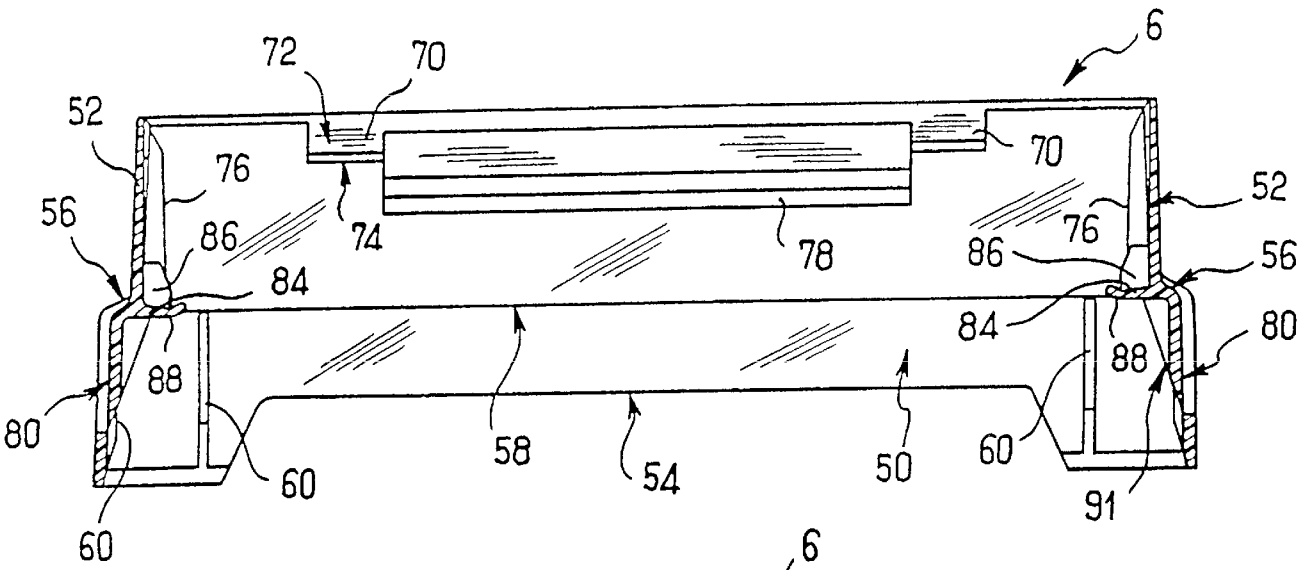
FIGS. 4 and 5 are respectively a longitudinal section and a cross-section of the FIG. 1 loader.
Figure 5:
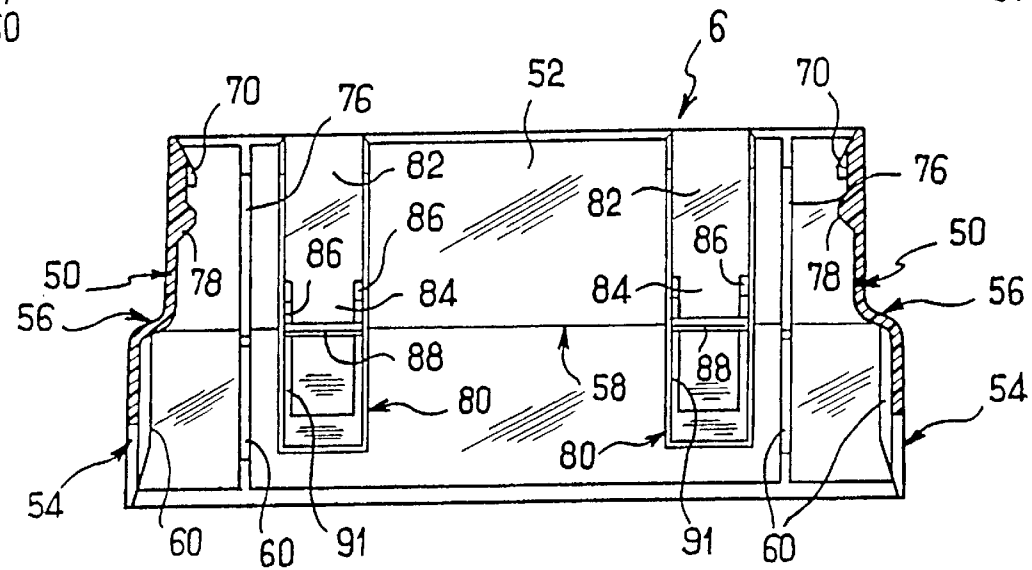
Figure 6:
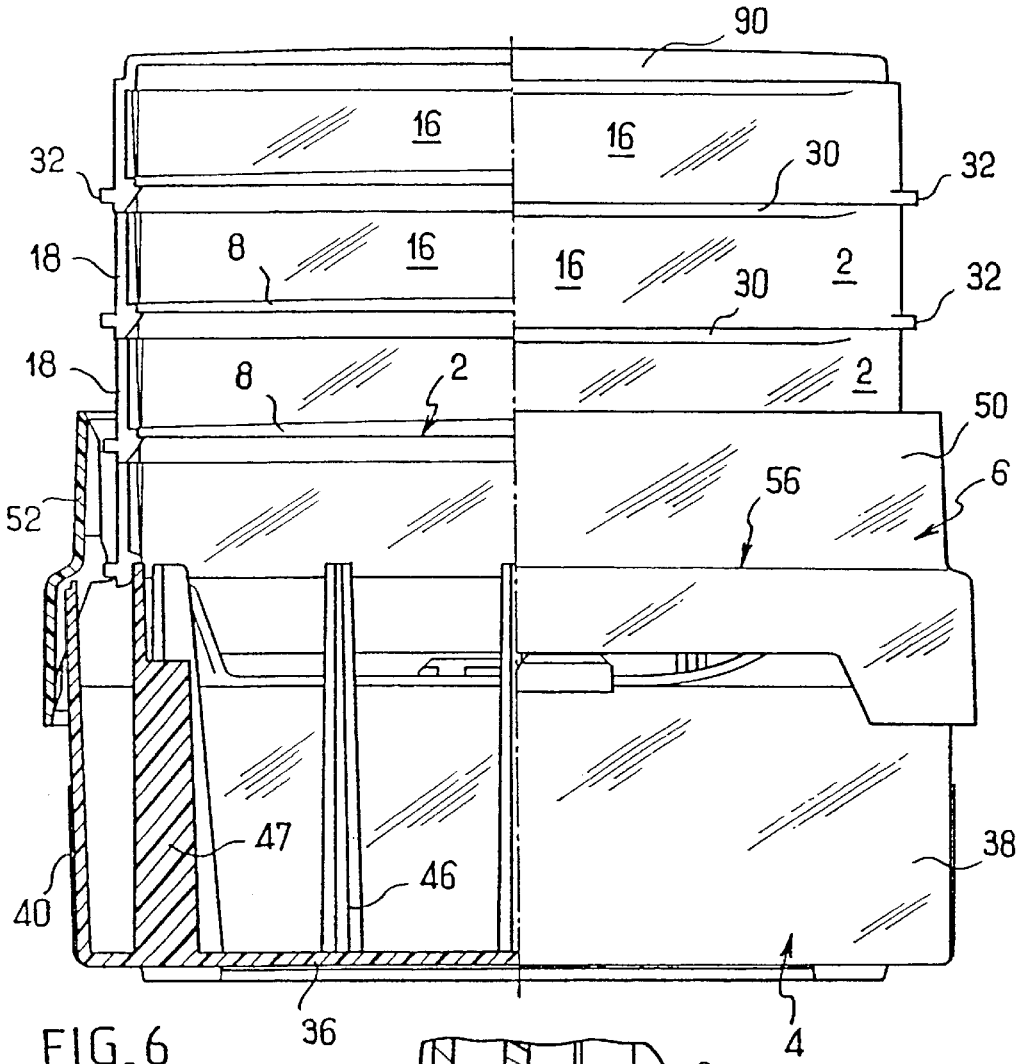
FIG. 6 is a view half in longitudinal section and half in elevation showing the assembly of FIG. 1.
Figure 7:
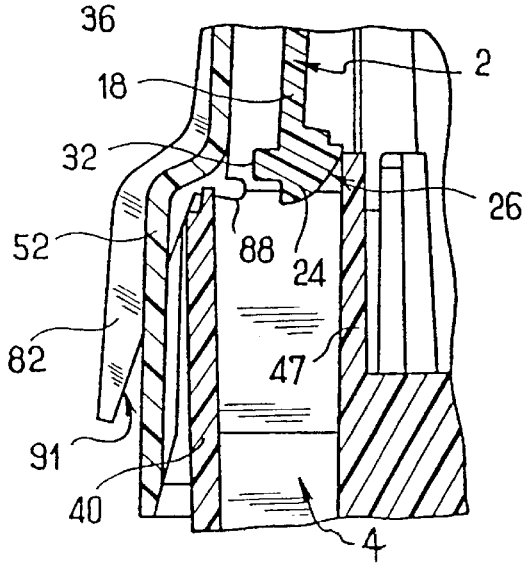
FIG. 7 is a view on a larger scale showing a detail of FIG. 6 with the deformed parts.
Figure 8:
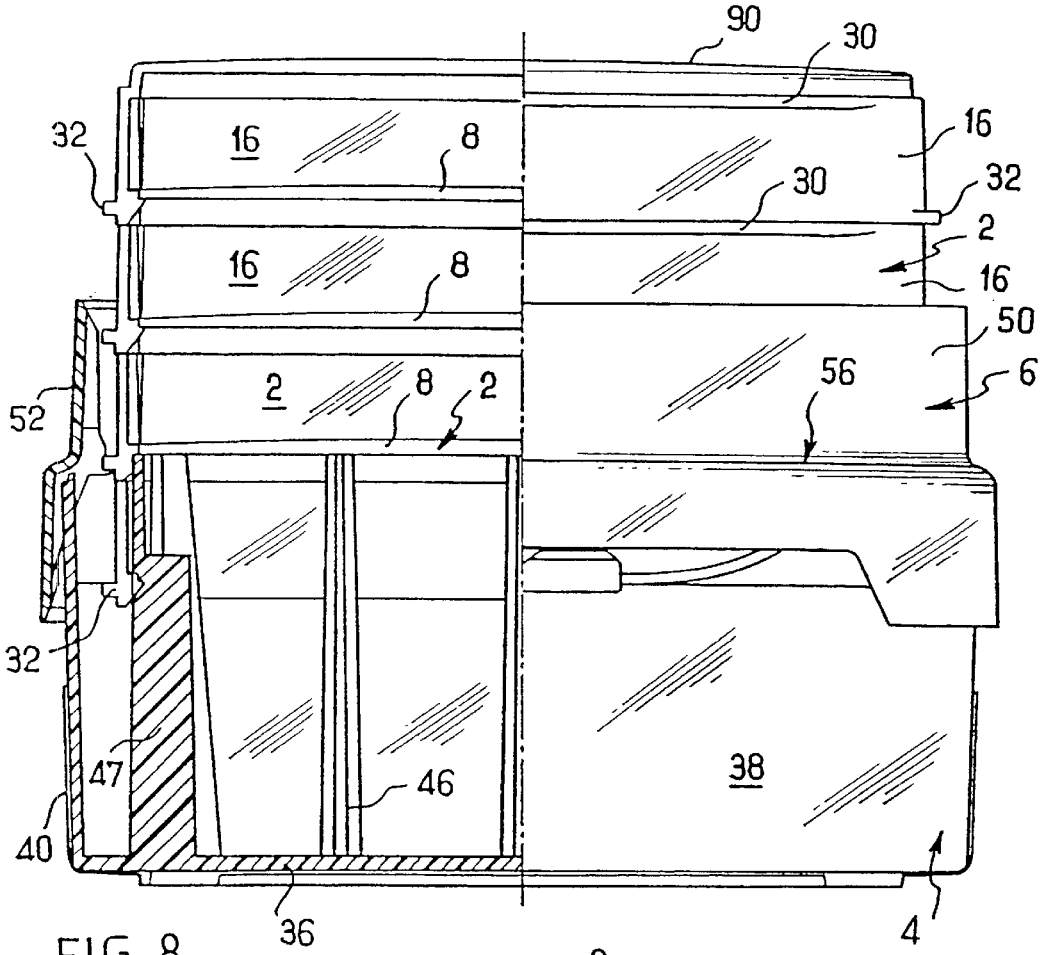
FIGS. 8 and 9 are views analogous to FIGS. 6 and 7 showing the FIG. 1 assembly after a rack has been loaded into the box.
Figure 9:
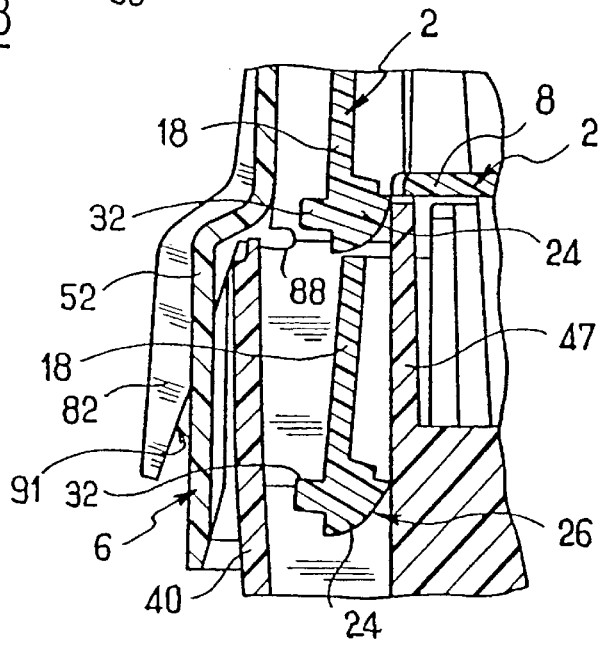
Figure 10:
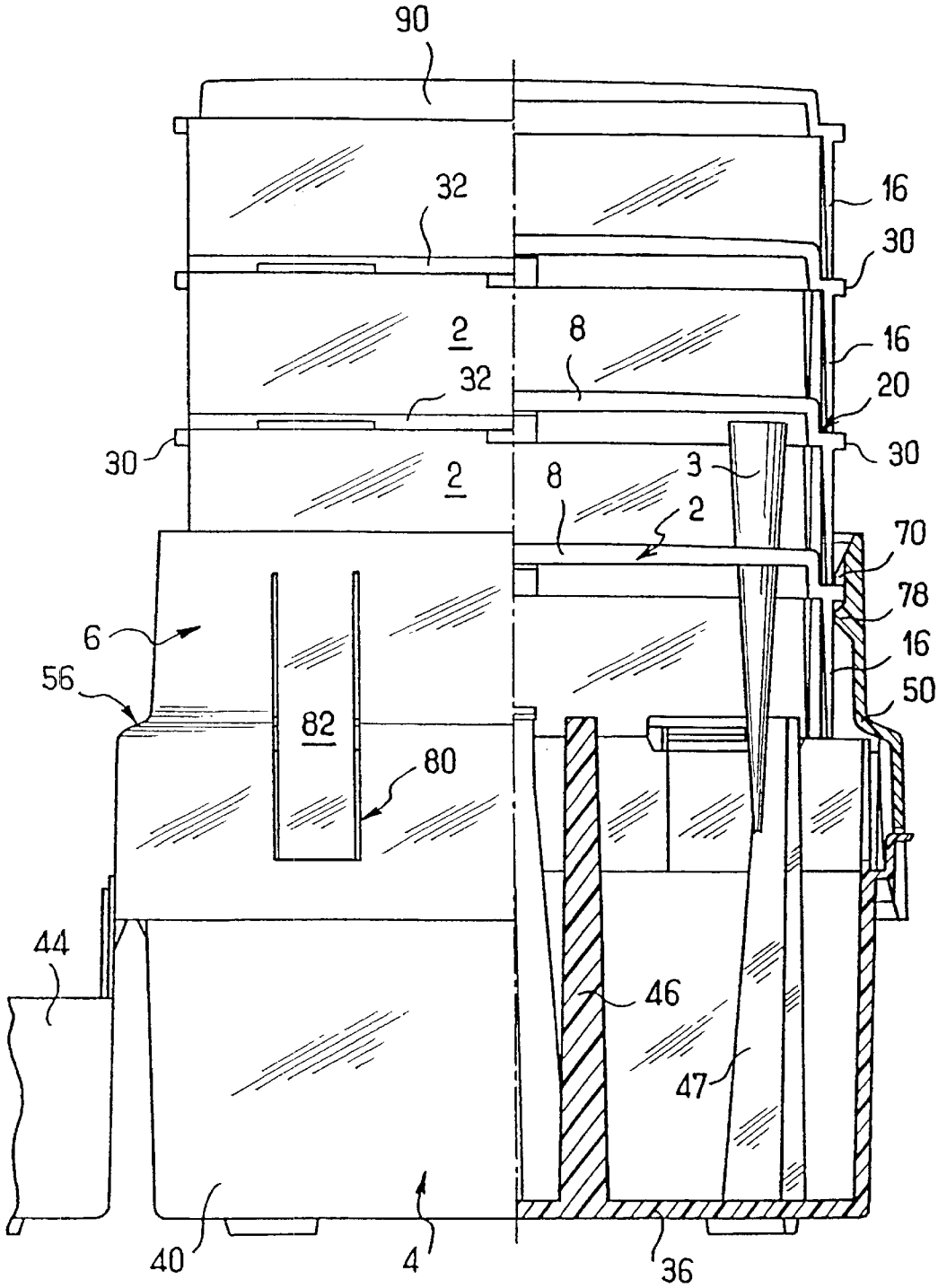
FIG. 10 is a view half in side view and half in cross-section showing the assembly of FIG. 1.

The loader 6 is described below, in particular with reference to FIGS. 4 and 5. It has two longitudinal walls 50 and two transverse walls 52 that are generally parallel in pairs, giving it the general shape of a rectangular parallelepiped and defining two mouths. At their bottom free edges, the longitudinal walls 50 have respective setbacks 54. The loader presents a general midplane that is perpendicular to its walls 50 and 52 and to its height direction, subdividing the loader into two portions, a top portion and a bottom portion, such that the length and the width of the top portion are smaller than the length and the width of the bottom portion. This difference in size is obtained by each of the walls 50 and 52 having a profile that is S-shaped. On the outside faces of the walls, the transition between the top and bottom portions is marked by a sloping facet 56, whereas on their inside faces the transition is provided by a shoulder forming a plane facet 58 perpendicular to the walls and facing downwards. The length and the width of the inside volume of the bottom portion are large enough to enable it to be engaged on and around the box 4, unlike the dimensions of the top portion. When the loader 6 is mounted in this way on an open box 4, the inside faces of the walls 50 and 52 of the bottom portion face the outside faces of the walls 38 and 40 of the box. The loader then bears against the free top edges of the walls of the box via its facet 58, or alternatively it bears against studs projecting therefrom.

The inside faces of the bottom portion have ribs 60 extending parallel to the height of the loader for the purpose of bearing against the outside faces of the walls 38 and 40 of the box so as to contribute to centering the loader on the box. The ribs 60 are chamfered at their bottom ends so as to facilitate engaging the loader on the box.

The means providing co-operation between the loader 6 and the rack 2 are described below. Each longitudinal wall 50 of the loader has catches 70, in this case two such catches, projecting from the inside face of the wall. Each catch 70 has its tip extending downwards. It is designed to enable a rack 2 to move downwards relative to the loader while preventing it subsequently from moving upwards. Each catch 70 has a plane top face 72 facing upwards, sloping downwards away from its top edge on the inside face and inwards towards the inside of the loader. The catch then continues downwards with a plane lower face 74 extending perpendicularly to the longitudinal inside face. Each catch 70 is contiguous to the top edge of the wall 50 and is located halfway between the longitudinal middle of said edge and a respective one of its ends.

When a stack of racks 2 is inserted into the top mouth of the loader, the longitudinal ribs 30 of the rack situated at the bottom end of the stack bear against the sloping top faces 72 of the catches 70. The four catches 70 are suitable for supporting the stack in this position which is referred to as the "topmost" or "unfixed high" position, the rack or the stack of racks still being capable at this stage of being extracted upwards from the loader. Each of the longitudinal walls 52 of the top portion of the loader has two vertical ribs 76 projecting from the inside face of said wall. The ribs 76 contribute to spacing and centering the bottom rack of the stack in the loader, by bearing against the longitudinal ribs 32 of the rack. These ribs 76 have chamfered top ends so as to facilitate insertion of the rack 2 or the stack into the loader.

Each of the longitudinal walls 50 in the top portion of the loader has a rectilinear rib 78 of triangular profile extending horizontally and projecting from its inside face beneath the catches 70, in register with the gap between them, but not in register with them. This rib 78 has sloping top and bottom faces respectively facing upwards and downwards.

Each of the transverse walls 52 in the bottom portion of the loader has two openings or holes 80 of rectangular shape into which there extend respective tabs 82 of corresponding shape. Each tab 82 is connected to the associated wall 52 via its top edge only, thereby allowing the tab 82 to move resiliently in bending through the opening 80, both inwards and outwards relative to the loader 52. When at rest, each tab 82 lies in the thickness of the wall. The outside face of the tab has an S-shape identical to that of the wall.

Each tab 82 has a catch 84 extending towards the inside of the loader projecting from the inside face of the transverse wall 52 when the tab is in its rest position. The catch 84 has two upper ribs 86 spaced apart from each other and facing each other at the same height, each having a top chamfer. The two ribs 86 could be replaced by a chamfer and a vertical face (which amounts to filling the empty space between the two ribs 86 with material). The catch 84 also has a horizontally shaped tip 88 extending inwards, projecting from the ribs 86 and sloping slightly upwards when the tab is in its rest position.

Starting from the above-mentioned topmost position, a small force urging the stack of racks downwards causes the racks 2 to move down to a "high" or a "fixed high" position. During this downwards movement, the longitudinal ribs 30 of the bottom rack of the stack force the catches 70 on the longitudinal wall of the loader outwards by forcing the longitudinal walls 50 that carry them to deform elastically outwards so as to allow the ribs to go past. Once they have gone past, the longitudinal ribs 30 of the rack bear against the two longitudinal ribs 78 of the loader and co-operate in centering therewith, and the transverse ribs 32 of the rack bear against the tips 88 of the catches 84. The longitudinal ribs 78 of the rack and the tips 88 of the catches prevent further downwards movement of the stack in the absence of force being applied by the user. In addition, the longitudinal catches 70 of the loader prevent the longitudinal ribs 30 of the rack from allowing the rack to move back upwards relative to the loader. The stack of racks 2 is thus fixed to the loader 6 solely via the rack that is situated at the bottom end of the stack. The subassembly can thus be manipulated in any direction quite freely without running the risk of the racks coming apart. The assembly of the invention advantageously has a rack cover 90 that is identical to the racks 2 in all features except that its tray 8 does not have any orifices 14 for receiving cones and does not have any fixing orifices 22. When fixed via its catches 24 to the top rack in the stack, it serves to protect the cones of that rack and to hold these cones in their orifices 14. When the above-mentioned subassembly is provided with this cover 90, it can be turned in any direction without running the risk of losing any cones. This position of the loader and of the stack is shown in FIGS. 1, 2, 3, 6, 7, 10, and 12. In this fixed high position, the subassembly with the loader can be removed from the box 4 or can be replaced thereon.

Figure 2:
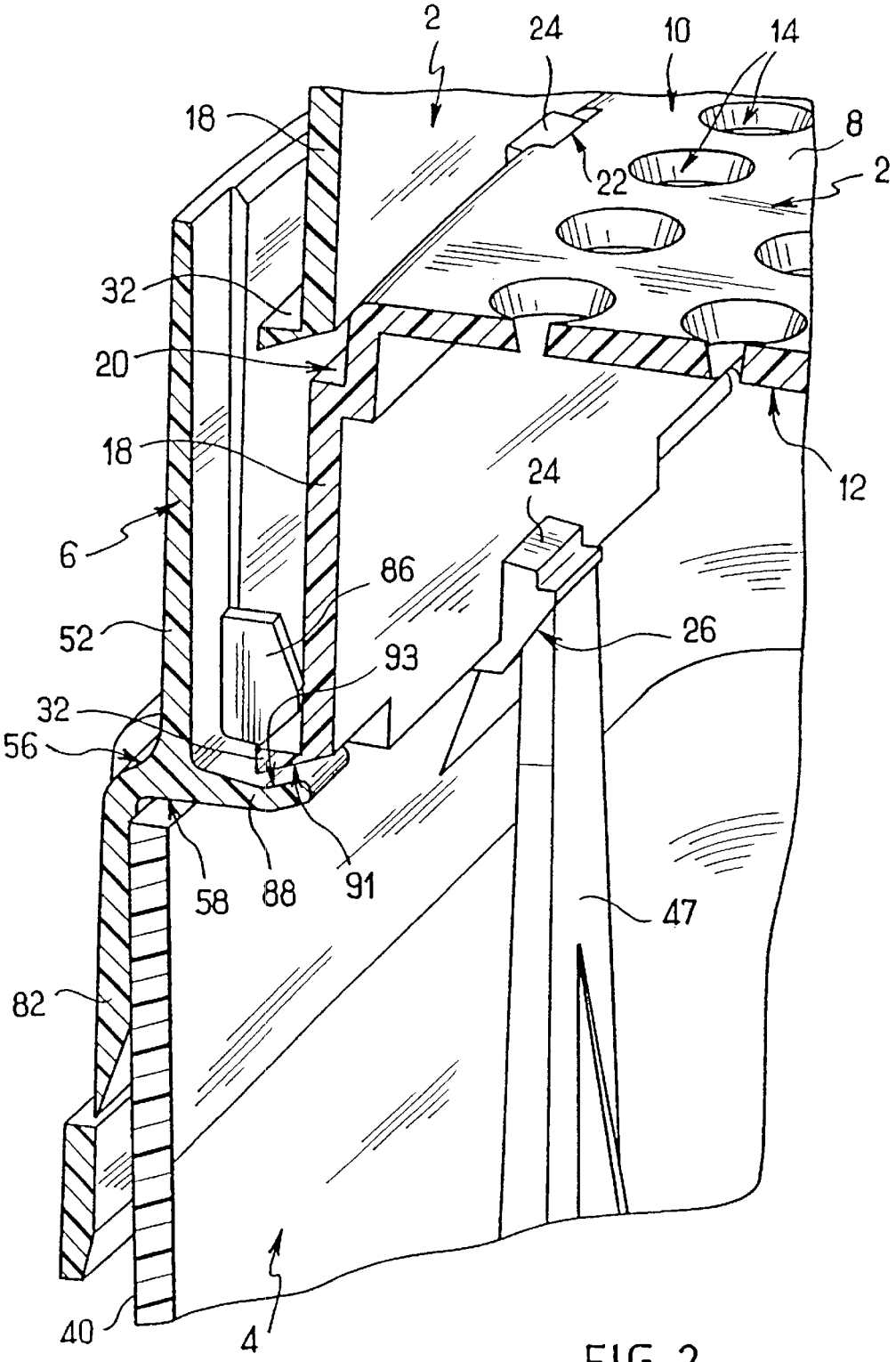
FIGS. 2 and 3 are two views on a larger scale showing two details of FIG. 1.
Figure 3:
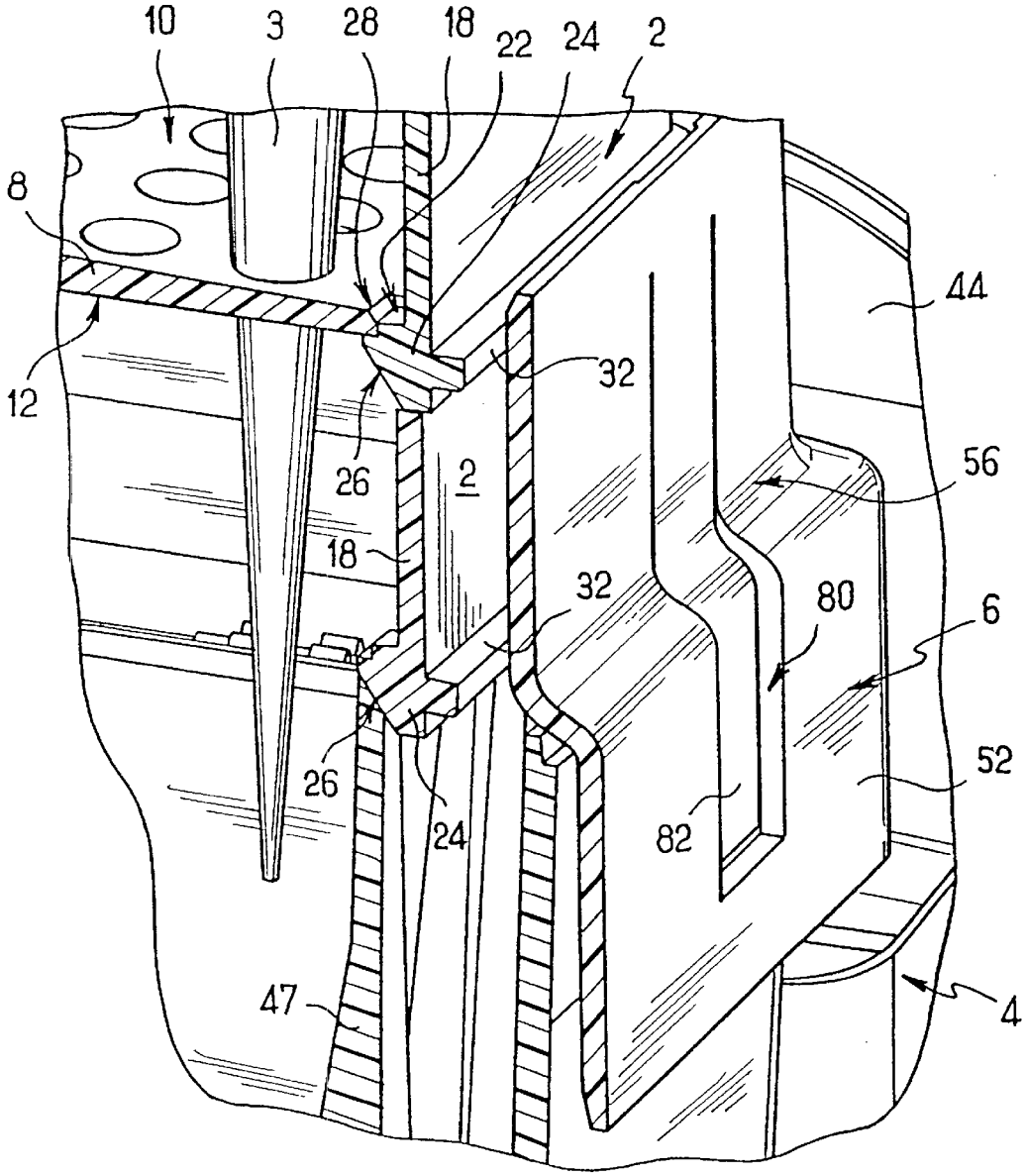

It is assumed below that the subassembly with the loader is received in the high position on the box that does not have a rack, as shown in FIG. 1. The tabs 82 of the loader have chamfers 91 at their bottom ends that face downwards and that are defined either by a face of the tab or by ribs thereon as shown, said chamfers projecting from the inside face of the transverse wall 52 when the tab is in its rest position. These chamfers 91 can be seen more particularly in FIGS. 4, 5, 7, and 9. When the loader 6 is engaged on the box 4, the chamfers 91 come into contact with the free top edges of the transverse walls 40 of the box and thus act as cams for forcing the respective tabs 82 outwards. This outwards movement causes the tip 88 of the catch 84 of each tab to move away from the rack, which rack continues to be supported by the internal longitudinal ribs 78 of the loader. Thus, the bottom rack is no longer supported by the catches 84. In addition, the position of the catch then allows the stack to move downwards on application of a force that is much less than that which would be needed in the absence of the box. In this respect, it is specified that FIG. 2 shows the parts assembled together but not deformed even though the tab in this position is normally deformed so that the catch 88 leaves a clear path for the rack. In addition, in this position, the central and peripheral studs 46 and 47 of the box already extend very slightly between the walls of the bottom rack. In particular, the middle peripheral studs 47 have their top ends bearing against the sloping bottom faces 26 of the transverse catches 24 of the rack so as to cause them to start moving apart, i.e. outwards as shown in FIG. 2. The ribs 60 serve to center the loader 6 (and thus the outline of the rack) relative to the box 4.

When the user forces the stack of racks downwards, e.g. by pressing on the top of the stack, the longitudinal ribs 30 of the bottom rack force the longitudinal ribs 78 of the loader to move apart together with the walls 50 carrying them, thereby enabling the rack to move downwards until it is received in the box. During this movement, the middle peripheral studs 47 move the catches 24 of the bottom rack further outwards by the camming effect of the ramps at the ends of the studs engaging the faces 26 of the catches. Immediately before the bottom rack is received so that it bears against the central studs 46 of the box, the top ends of the middle peripheral studs 47 come to bear via the inside of the bottom rack through the corresponding orifices 22 with the catches 24 associated with the next rack up in the stack. The stud 47 bears against the bottom face 26 of the catch, thereby urging it outwards by a camming effect. This outwards movement is sufficient to disengage the catch 24 of the next rack up from the orifice 22 of the rack that is about to be received in the box. This unlocks the rack fixing means.

As the stack moves downwards, the next rack up takes up the fixed high position. Once the downwards movement has come to an end, the central studs 46 prevent any further downwards movement of the stack. The subassembly comprising the remainder of the stack and the loader 6 fixed thereto can then be removed from the box 4. This operation gives access to the rack 2 received in the box and above all to its cones 3 which can then be used directly.

After the cones have been used, it suffices to remove the rack 2 from the box, to replace the subassembly on the box, and to load a new full rack in the box by using the same operations of forcing the stack downwards. The same operations can be repeated until the last rack of the stack which, once in the box, leaves the cover 90 on its own in the loader 6.

As shown in FIG. 2, each rack can, at each location of its bottom edge that is to come into register with the catch 88, present a bottom sloping ramp face 91 facing towards the inside of the rack and suitable for coming into surface contact with an associated sloping top ramp face 93 of the catch 88 and facing towards the transverse wall 52 of the loader carrying the tab 82. Thus, when the loader is supporting the stack of racks without being received on the box but standing on a work surface, the two ramp surfaces 91 and 93 come mutually into contact. Thus, under the effect of gravity or of untimely thrust from a user, the stack of racks tends to move downwards with the camming co-operation between the two faces 91 and 93 tending to move the catch 88 towards the inside of the rack, i.e. in the direction opposite to the direction that would allow the rack to be released when the loader is received on the box. This provides a safety feature that locks the stack of racks against moving down inside the loader whenever the loader is not received on a box.

The box whose dimensions are not tied to the dimensions of the cones 3 can be associated with stacks of racks 2 containing cones of different diameters.

As the racks are used up, the height of the assembly decreases, thereby saving space.

A second preferred embodiment of the invention is described below with reference to FIGS. 17 to 30. The assembly is very similar to that of the first embodiment. Nevertheless, it incorporates a number of variants, which can indeed be implemented independently of one another.

In the assembly constituting the first embodiment, the rack 2 in its in-use position in the box 4 is fixed rigidly thereto by friction, in particular by the contact between the middle studs 47 and the transverse catches 24. The rack is thus clamped to the box.

However, it is advantageous for such an assembly to be capable of being put into an autoclave while in this configuration. Typically, the autoclave includes a step of raising temperature to 121° C. over a period of 20 minutes. However, it has been found that under the effect of temperature rise, the plastics material of the rack softens and the rack deforms so that the clamping is reduced to nothing. After a period in the autoclave, the assembly cools down but its parts retain their deformation: there is no longer any clamping. Consequently, the rack is no longer fixed to the box and that gives rise to problems when users take cones or knock the box over.

The first of the variants described below seeks to mitigate that drawback. Each rack 2 comprises above each catch 24 another catch 101 that likewise projects inwards. The middle studs 47 for unlocking purposes present respective cavities 100 in their peripheral faces within which the corresponding catch 101 is received once the rack 2 has been received in the box 4 in the in-use position. The catch 101 is received in said cavity because of the resilience of the wall 18 which is elastically deformed immediately prior to the rack being received in the box. The cavity 100 forms an edge with which the catch 101 comes into engagement to prevent the rack 2 from being separated from the box unless a particularly large amount of force is exerted in this direction by the user. They are thus rigidly fixed together. In this position, the catch 101 can be received in the cavity, possibly without exerting force on the middle stud.

By means of such fixing, the assembly can be subjected to successive passages through an autoclave without degrading fixing between the rack and the box. Furthermore, in the above-described case where the catch 101 is received without applying force to the rack 2, the passage through an autoclave does not give rise to any deformation. The assembly of the invention can thus be subjected to repeated passages through an autoclave.

Another variant incorporated in this embodiment consists in making at least one plane rib 102 parallel to the studs in the box and interconnecting some of them so as to reinforce them. Specifically, the rib 102 extends in a middle longitudinal plane of the box and interconnects the middle peripheral studs 47.

Furthermore, as seen in the first embodiment, when the loader 6 supports the stack of racks 2 outside the box 4, the stack of racks stands on the catches 88 and thus on the flexible tabs 82. Unfortunately, in the event of an impact, it can happen that the stack of racks exerts sufficient force on the tabs as to cause at least one of the tabs to break.

A variant incorporated in the second embodiment seeks to mitigate that drawback. To this end, the assembly constituting the second embodiment includes a stand 106 shown in FIGS. 28 to 30. The stand is made as a single part. It presents a central body 108 of shape and dimensions close to those of a rack 2 except that it does not have a tray between the top edges of its walls, but in contrast it does have a bottom 110 between their bottom edges.

Figure 29:
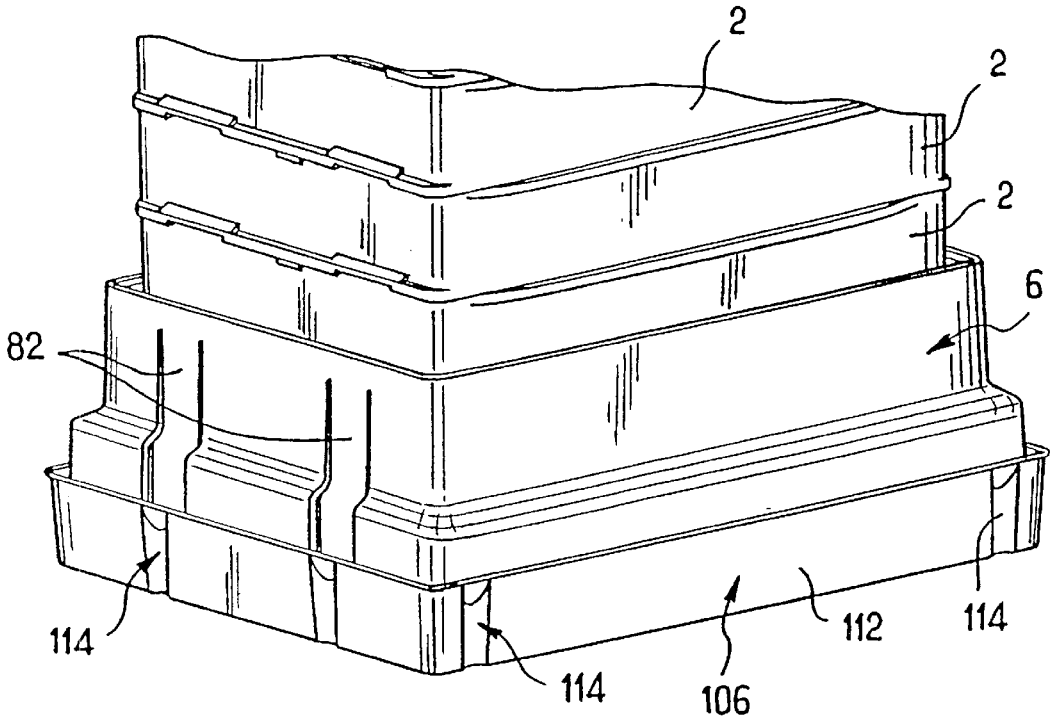
FIG. 29 is an overall view of the second embodiment received on the stand of FIG. 28.
Figure 30:
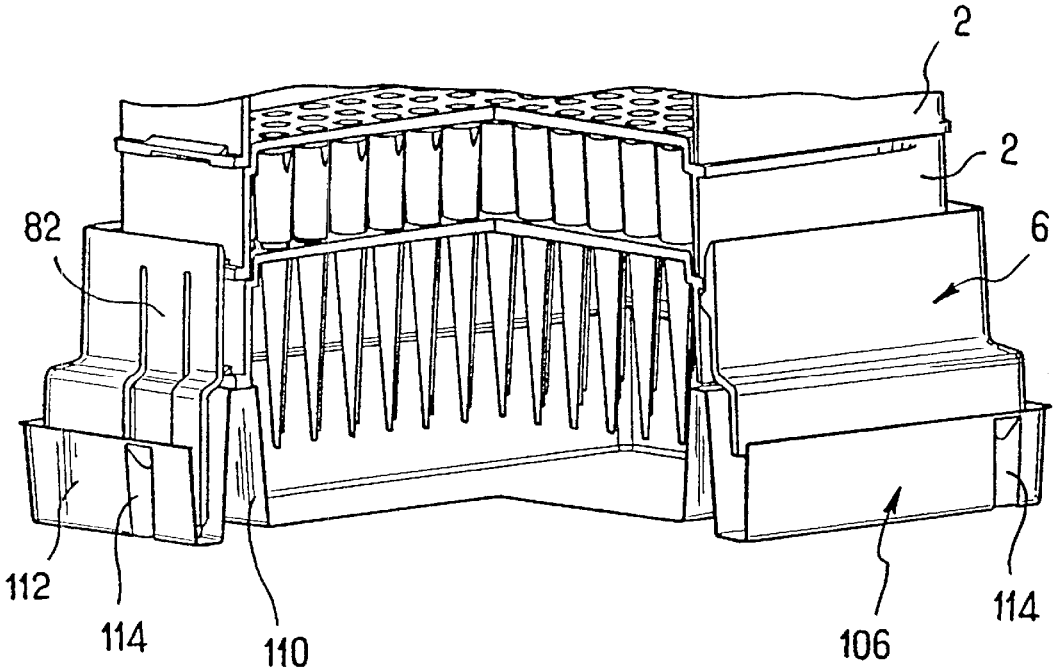
FIG. 30 is a view analogous to FIG. 29 that has been partially cut away.

The rectangular top edge 112 of this central body is suitable for directly supporting the bottom edge of the rack 2 at the bottom of the stack. For this purpose it has cutouts, in particular for providing a volume for receiving the catches 24 of the rack. The stand 106 also has a rectangular peripheral collar 112 surrounding the central body 108 at a distance therefrom, and of slightly smaller height. The central body 108 converges slightly in an upward direction while the collar 112 flares slightly in that direction. The stand 106 is designed to be suitable for receiving the loader 6 supporting a stack of racks after it has been removed from the box 4, as shown in FIGS. 29 and 30. For this purpose, the loader 6 is placed on the stand 106 by inserting its walls between the central body 108 and the collar 112. On penetrating into the loader, the central body comes into contact with the bottom edge of the bottom rack 2 of the stack that it is supporting. Under such circumstances, the tabs 82 of the loader are no longer carrying the stack of racks. The stack of racks can thus accommodate considerable impacts without running any risk of damaging the loader. The loader 6 together with the stack can then subsequently be taken freely from the stand 106 and put back on the box 4.

To fix the stand 106 to the loader 6 in the position of FIG. 29, the collar 112 has fluting 114 to form ribs of semicircular cross-section on the inside face of the collar. When the loader 6 is placed on the stand 106, the walls of the loader are jammed between the fluting 114 and the central body 108. This provides a friction connection between the loader and the stand. Specifically, some of the fluting is located so as to extend in register with the tabs 82.

Furthermore, the assemblies in both embodiments of the invention are designed to be suitable for receiving pipette cones of different models, in particular cones with a variety of collar heights, where the term "collar" is used for the larger portion of the cone that extends above the tray of the rack while the cone is being carried by a rack.

In the first embodiment, in order to place high-collar cones in the box, it is necessary to provide sufficient space between the curved surface of the rack (against which the collars bear) and the end wall of the lid. Under such circumstances, when small-collar cones are placed in the box, should the user for any reason happen to overturn the box (e.g. while putting it in an autoclave), then the cones escape from their housings. On opening the box, the user will find cones that are disposed in a jumble and that are thus unusable.

In the second embodiment, a variant is incorporated that seeks to remedy that drawback. Thus, with reference to FIGS. 22 to 27 the assembly constituting the second embodiment has a holder 120 comprising a flat rectangular body 121 presenting orifices 122. Overall, the body has the same shape and the same dimensions as the top tray 8 of the racks 2. The holder 120 has struts 124 projecting from its transverse edges, e.g. two such struts, suitable for engaging in blind orifices 126 in the transverse walls of the lid 44 so as to secure the holder in releasable manner to the lid. These orifices 126 extend in this case close to an edge of the lid that is a bottom edge when the lid is in the closed position. The struts 124 therefore slope.

The holder also has spacers 126 in the form of fingers extending from a plane face of the body 121 towards the end wall of the lid 44 so as to maintain a minimum spacing between the body 121 and the end wall of the lid.

When cones of low collar height are stored in the box, the holder 120 is mounted in the lid 44. When the lid is closed, the body 121 comes into register with the collars in the immediate vicinity thereof and prevents them from escaping from the rack, even if the box is turned upside-down. If cones of greater collar height are to be stored, then it suffices to remove the holder 120 from the lid prior to closing it.

The box could be implemented with the holder independently of the characteristics of the tower of racks and independently even of the presence of a tower of racks.

Refills could be provided in the form of trays provided with legs having mutual fixing tabs.

Each of these elements comprising the loader, the box, and its lid can be made as a single piece, e.g. out of plastics material.

The assembly could be designed to carry other elements, e.g. ice cream cones.

We claim:

1. An assembly for elements (3), in particular pipette cones, the assembly comprising at least two refills (2) suitable for forming a stack and carrying elements (3), refill handler means (4, 6) for receiving the stack and separating one of the refills (2) from the remainder of the stack, and fixing means (22, 24) for releasably attaching the refills (2) to one another within the stack, the assembly being characterized in that said refills (2) include the fixing means (22, 24), wherein the fixing means (22, 24) comprise fixing portions suitable for mutual male-female engagement, wherein the handler means (4, 6) are suitable for applying force to the fixing portions (22, 24) so as to disengage them, and wherein, on each refill (2), the fixing means comprise an orifice (22) and a catch (24) suitable for engaging the orifice of another refill.

2. An assembly according to claim 1, wherein the handler means (4, 6) include a member (47) suitable for applying force to the catch (24) from a side of the orifice (22) opposite from the catch (24).

3. An assembly for elements (3), in particular pipette cones, the assembly comprising at least two refills (2) suitable for forming a stack and carrying elements (3), refill handler means (4, 6) for receiving the stack and separating one of the refills (2) from the remainder of the stack, and fixing means (22, 24) for releasably attaching the refills.(2) to one another within the stack, the assembly being characterized in that said refills (2) include the fixing means (22, 24), wherein the handler means (4, 6) are suitable for carrying the stack prior to unlocking the fixing means (22, 24).

4. An assembly for elements (3), in particular pipette cones, the assembly comprising at least two refills (2) suitable for forming a stack and carrying elements (3), refill handler means (4, 6) for receiving the stack and separating one of the refills (2) from the remainder of the stack, and fixing means (22, 24) for releasably attaching the refills (2) to one another within the stack, the assembly being characterized in that said refills (2) include the fixing means (22, 24), wherein the handler means (4, 6) comprise a loader (6) suitable for receiving the stack, and a receptacle (4) suitable for receiving one of the refills (2) in the in-use position for the elements (3) from the loader, and wherein the receptacle (4) is suitable for unlocking the refill fixing means (22, 24).

5. An assembly for elements (3), in particular pipette cones, the assembly comprising at least two refills (2) suitable for forming a stack and carrying elements (3), refill handler means (4, 6) for receiving the stack and separating one of the refills (2) from the remainder of the stack, and fixing means (22, 24) for releasably attaching the refills (2) to one another within the stack, the assembly being characterized in that said refills (2) include the fixing means (22,

24), wherein each refill (2) comprises a tray (8) and at least one rib (30, 32) parallel to the tray and projecting from a side face (16, 18) of the refill.

6. An assembly for elements (3), in particular pipette cones, the assembly comprising at least two refills (2) suitable for forming a stack and carrying elements (3), refill handler means (4, 6) for receiving the stack and separating one of the refills (2) from the remainder of the stack, and fixing means (22, 24) for releasably attaching the refills (2) to one another within the stack, the assembly being characterized in that said refills (2) include the fixing means (22, 24), wherein each refill (2) comprises a tray (8) and spacers (16, 18) suitable for supporting the tray on a plane support and at a distance therefrom.

7. An assembly according to claim 6, wherein the fixing means comprise an orifice (22) and a catch (24) suitable for engaging the orifice of another refill and one of the orifice (22) and the catch (24) is contiguous with an edge of the tray (8).

8. An assembly for elements (3), in particular pipette cones, the assembly comprising at least two refills (2) suitable for forming a stack and carrying elements (3), refill handler means (4, 6) for receiving the stack and separating one of the refills (2) from the remainder of the stack, and fixing means (22, 24) for releasably attaching the refills (2) to one another within the stack, the assembly being characterized in that said refills (2) include the fixing means (22, 24) wherein the handler means (4, 6) comprise a receptacle (4) suitable for receiving one of the refills (2) in an in-use position for the elements (3) after the refill has been separated from the stack, wherein the receptacle (4) is arranged in such a manner that receiving a refill (2) in the in-use position on the receptacle (4) causes the refill (2) to be fixed rigidly to the receptacle (4), and wherein each refill (2) includes at least one catch (101) suitable for co-operating with a portion (100) of the receptacle (4) in order to achieve said rigid fixing.

9. An assembly for elements (3), in particular pipette cones, the assembly comprising at least two refills (2) suitable for forming a stack and carrying elements (3), refill handler means (4, 6) for receiving the stack and separating one of the refills (2) from the remainder of the stack, and fixing means (22, 24) for releasably attaching the refills (2) to one another within the stack, the assembly being characterized in that said refills (2) include the fixing means (22, 24), wherein the handler means (4, 6) comprise a receptacle (4) suitable for receiving one of the refills (2) in an in-use position for the elements (3) after the refill has been separated from the stack, wherein the receptacle (4) is arranged in such a manner that receiving a refill (2) in the in-use position on the receptacle (4) causes the refill (2) to be fixed rigidly to the receptacle (4), and wherein the receptacle includes a lid (44) and a holder (120) suitable for extending in register with elements (3) of a rack (2) received in receptacle (4) so as to prevent the elements from leaving the rack when the lid closes the receptacle, the holder and the lid having means (124, 126) for releasably securing the holder to the lid.

10. An assembly according to claim 1, wherein each refill (2) comprises a tray (8) and spacers (16, 18) suitable for supporting the tray (8) and one of the orifice (22) and the catch (24) is contiguous with an edge of the tray (8).

11. An assembly for elements (3), in particular pipette cones, the assembly comprising at least two refills (2) suitable for forming a stack and carrying elements (3), refill handler means (4, 6) for receiving the stack and separating one of the refills (2) from the remainder of the stack, and fixing means (22, 24) for releasably attaching the refills (2) to one another within the stack, the assembly being characterized in that said refills (2) include the fixing means (22, 24), wherein the handler means (4, 6) comprise a receptacle (4) suitable for receiving one of the refills (2) in an in-use position for the elements (3) after the refill has been separated from the stack, and wherein said assembly includes a stand (106) suitable for directly supporting the stack when the loader (6) is carrying the stack and when the receptacle (4) is not receiving the loader (6).

12. An assembly for elements (3), in particular pipette cones, the assembly comprising at least two refills (2) suitable for forming a stack and carrying elements (3), refill handler means (4, 6) for receiving the stack and separating one of the refills (2) from the remainder of the stack, and fixing means (22, 24) for releasably attaching the refills (2) to one another within the stack, the assembly being characterized in that said refills (2) include the fixing means (22, 24), wherein the handler means (4, 6) comprise a receptacle (4) suitable for receiving one of the refills (2) in an in-use position for the elements (3) after the refill has been separated from the stack, and wherein the receptacle includes a lid (44) and a holder (120) suitable for extending in register with elements (3) of a rack (2) received in receptacle (4) so as to prevent the elements from leaving the rack when the lid closes the receptacle, the holder and the lid having means (124, 126) for releasably securing the holder to the lid.

13. A pipette cone assembly comprising:

a stack containing a plurality of racks, said racks supporting pluralities of pipette cones;

each said rack including a first catch structure to lock the rack to an adjacent rack in the stack;

a loader receiving an end rack of the stack, said loader including a second catch structure locking said loader onto said end rack; and a receptacle receiving said loader;

said receptacle including a catch release structure for releasing said first latch structure for dispensing said end rack into said receptacle.

14. A pipette cone assembly as claimed in claim 13, said receptacle including a second catch release structure for releasing said second catch structure.

* * * * *